United States Patent [19]

VanWagenen et al.

[11] 4,188,859

[45] Feb. 19, 1980

[54] FLUID DRIVE MECHANISMS AND METHODS

[76] Inventors: Norman L. VanWagenen, 378 Truman Ave., Salt Lake City, Utah 84115; A. Norman Lamph, 540 N. 200 E., Bountiful, Utah 84010

[21] Appl. No.: 944,484

[22] Filed: Sep. 21, 1978

[51] Int. Cl.[2] ..... F01B 3/00; F01B 13/04

[52] U.S. Cl. ..... 91/499; 91/505; 91/506; 417/269; 60/487

[58] Field of Search ..... 91/499, 503, 504, 505, 91/506; 92/12.1, 12.2, 13.1; 417/269, 222; 60/327, 487, 488

[56] References Cited

U.S. PATENT DOCUMENTS

| | | | |
|---|---|---|---|
| 3,036,434 | 5/1962 | Mark | 60/488 X |
| 3,131,539 | 5/1964 | Creighton et al. | 60/487 |
| 3,713,291 | 1/1973 | Kubik | 60/381 X |

*Primary Examiner*—Edgar W. Geoghegan
*Attorney, Agent, or Firm*—Lynn G. Foster

[57] ABSTRACT

A fluid driven mechanism in the form of a fluid motor or fluid pump which is transmissionless, wherein speed and power are selectively varied by the operator through corresponding adjustment in the orientation of angularly disposed power transmitting structure. A large capacity unrestricted rotating fluid distributor vortically and cyclically directs ingress fluid successively to a series of pistons which is power-related to the power transmitting structure. The fluid distributor is uniquely caused to float during its rotation by oppositely imposed fluid under pressure within aligned eccentric chambers, each chamber being formed partly in the rotating distributor and partly in adjacent stationary structure.

28 Claims, 30 Drawing Figures

24
24
720
722
724
726
728
730
732
738
710
670
672
674
676
677
678
686
688
690
694
696
700
702
704
706
760
762
764
766
768
770
772
774
776
778
780
782
784
786
788
790
792
794
796
798
800
600
601
602
604
605
606
608
610
612

8
123
123
140
115
150
115
156
152
115
123
142
117
152
117
127
127
121
148
119
144
146
113
113
119
129
113
121
121
129
121
113
129
121
154
121
8

142
144
123
144
123
115
150
156
140
127
156
146
117
148
148
146
129
119
129
154
154
121
121
144
113
142
144

10
186
186
188
180
190
198
188
174
176
196
190
186
188
184
182
186
188
190
172
186
188
170
10

186
170
194
174
180
192
176
190
202
184
178
194
182
176
190
176
180
192
174
188
194
174
172

FLUID DRIVE MECHANISMS AND METHODS

BACKGROUND

1. Field of Invention

This invention relates to fluid mechanisms including fluid motors and fluid pumps wherein substantial power or torque is required and/or substantial speed.

2. Prior Art

In the recent past, substantial effort has been devoted to the generating of power e.g. in automobiles, etc. in an efficient, simplified and pollution-free manner. Reduction or elimination of petroleum-based fuels has also received substantial attention. Only limited inquiry has been made into deriving variable speed and power in automobiles and the like using one or more fluid motors. The principles of limited fluid flow and pressures and low fixed torque, such as is available from apparatus corresponding to the subject matter of our U.S. Pat. No. 3,823,557, do not apply. A further paramount problem relates to the manner in which fluid energy is to be converted to speed and power and, more particularly, to how the speed and power are to be selectively varied to allow the automobile to negotiate the various types of terrain over which it is caused to pass. While wobble plate conversion of fluid energy to shaft rotation is known, the prior art made no provision for controlled variation in speed and power using a wobble plate approach. See U.S. Pat. Nos. 748,083; 927,297; 2,115,556; 3,016,837; 3,212,448; 3,246,575 and 3,636,820, as well as Italian Pat. No. 557,167 and British Pat. No. 707,254.

BRIEF SUMMARY AND OBJECTS OF THE PRESENT INVENTION

In brief summary, the present invention comprises fluid driven mechanisms and related methods, the mechanisms preferably being in the form of fluid motors and fluid pumps which are transmissionless, wherein speed and power are selectively varied by the operator through corresponding adjustment in the orientation of angularly disposed power transmitting structure. A large capacity unrestricted rotating fluid distributor directs ingress fluid successively to power structure without substantial reduction to the pressure thereof and without substantial restriction in the flow rate. Non-binding flotation of the fluid distributor during its rotation is achieved by oppositely imposed fluid pressure within aligned eccentric chambers, each chamber being disposed partly in the rotating distributor and partly in adjacent stationary structure.

In light of the foregoing, it is a primary object of the present invention to provide novel fluid drive mechanisms and related methods.

It is a further paramount object according to the present invention to provide novel fluid motors and unique fluid pumps.

A further important object of the present invention is to provide a fluid drive mechanism which is transmissionless in varying the speed and power thereof in accordance with the desire of the operator and existing conditions.

A further significant object according to the present invention is the provision of a novel fluid driven mechanism wherein variations in speed and power are selectively obtained through corresponding adjustment in the orientation of angularly disposed power transmitting structure.

An additional principal object of the present invention is the provision of a large capacity unrestricted rotating fluid distributor which delivers fluid to power structure without substantial reduction in pressure or restriction in flow.

An additional paramount object of the present invention is the provision of a novel fluid distributor and structure for causing non-binding flotation of the distributor during its rotation.

These and other objects and features of the present invention will be apparent from the detailed description taken with reference to the accompanying drawings.

DETAILED DESCRIPTION OF THE ILLUSTRATED EMBODIMENTS

Figure 5:
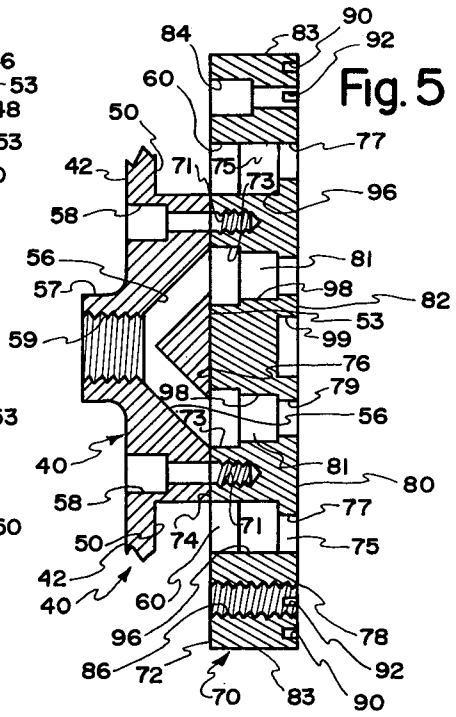
FIG. 5 is an enlarged cross section of the first distributor plate of the fluid drive mechanism of FIG. 1 and part of the end cap.
Figure 4:
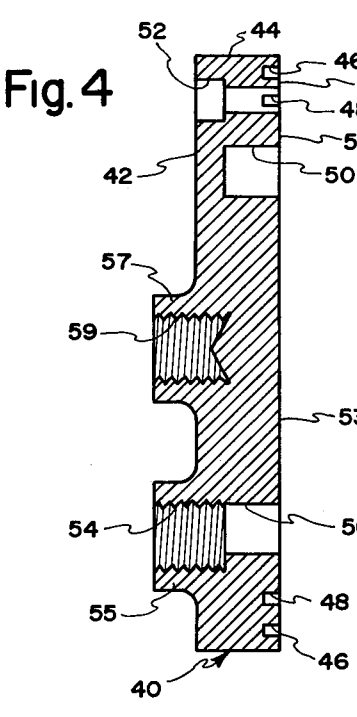
FIG. 4 is an enlarged cross section of the end cap of the fluid drive mechanism of FIG. 1.
Figure 6:
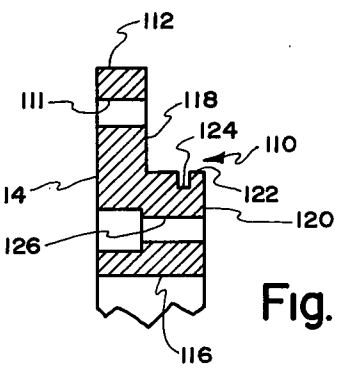
FIG. 6 is an enlarged fragmentary cross section of the distributor housing of the fluid drive mechanism of FIG. 1.
Figure 1:
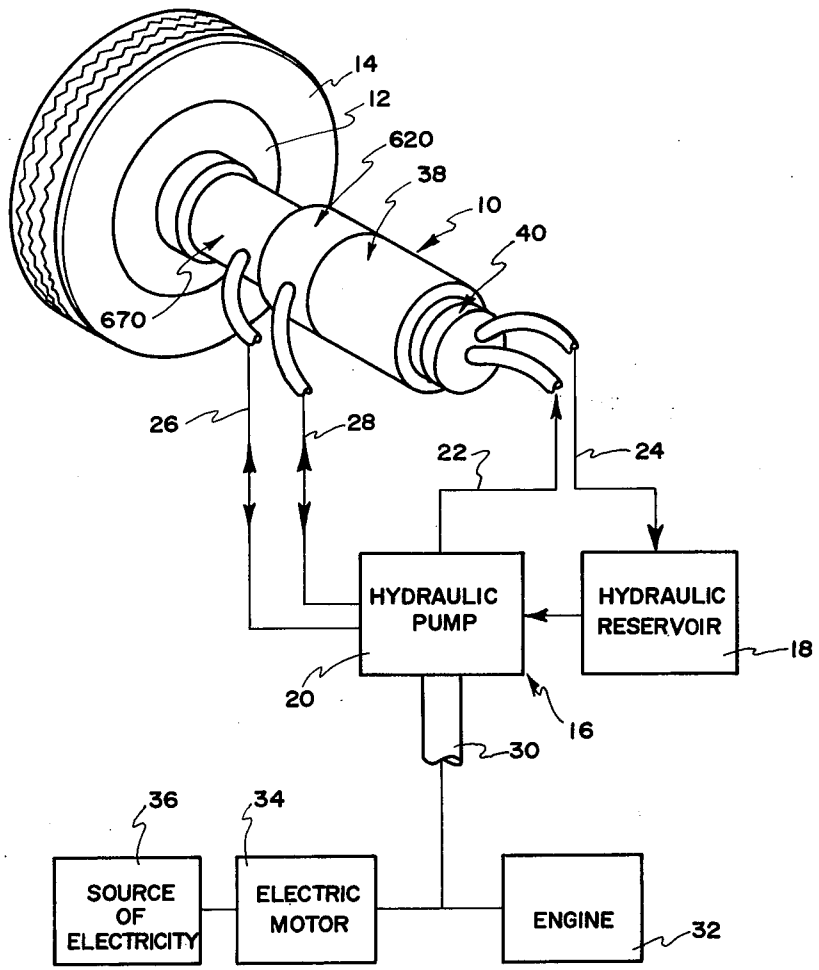
FIG. 1 is a schematic representation of a fluid system including one presently preferred fluid drive mechanism according to the present invention attached to a wheel.
Figures 2, 2A, 2B, 2C:
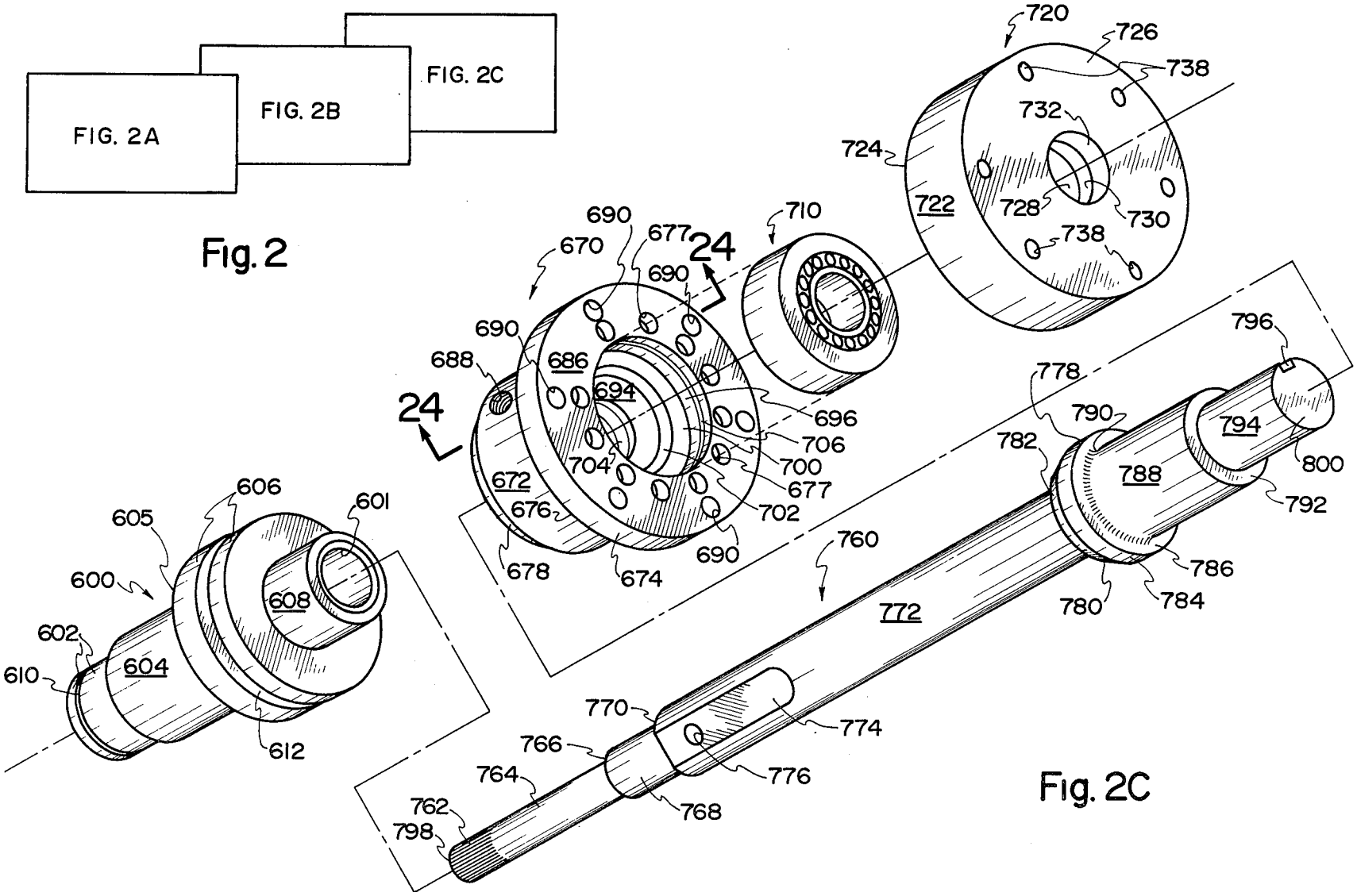
FIG. 2 is a schematic representation illustrating the manner in which FIGS. 2A, 2B and 2C interrelate.
FIGS. 2A, 2B and 2C, taken together, comprise an enlarged exploded perspective of the fluid drive mechanism of FIG. 1.
Figure 2A:
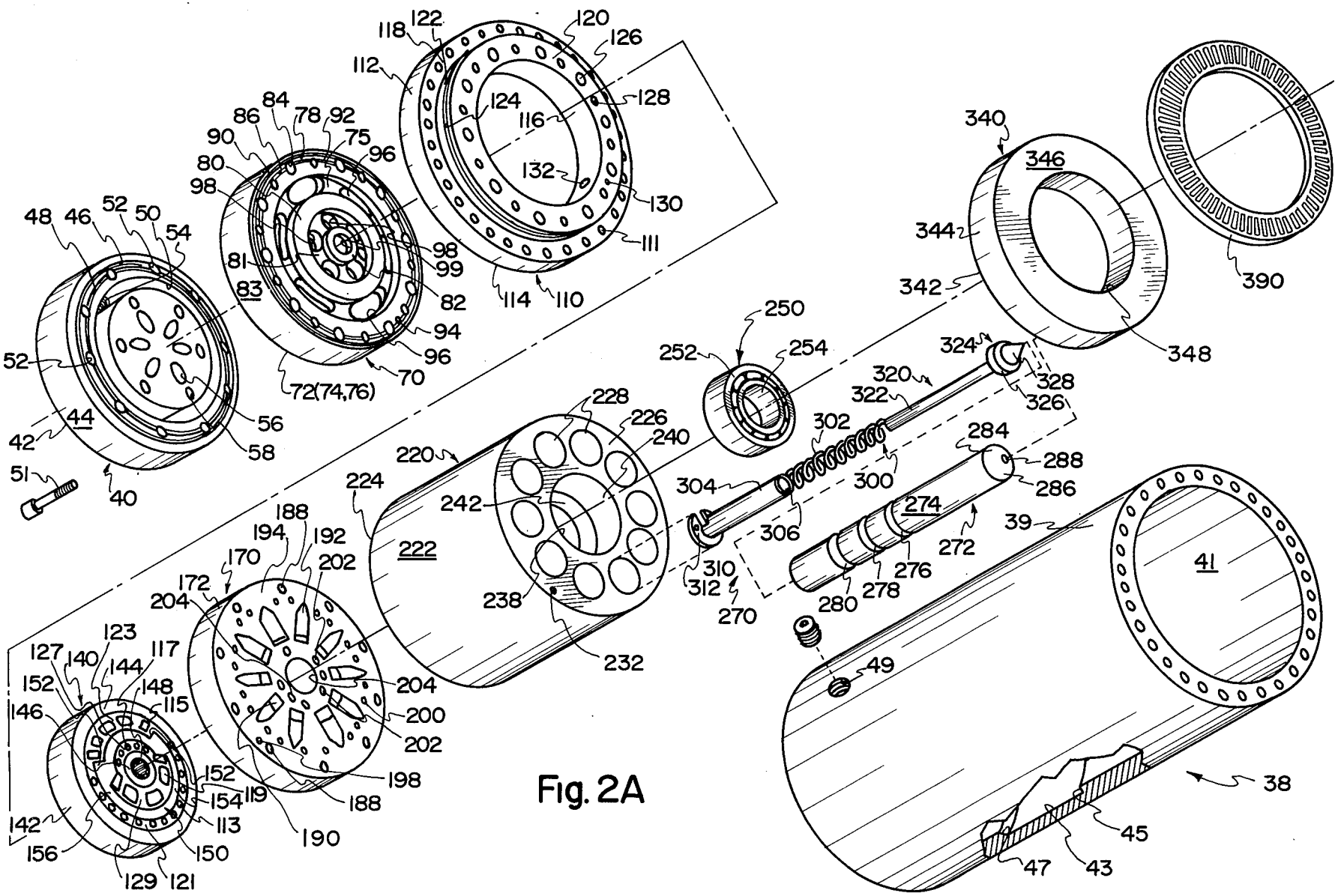
Figure 2B:
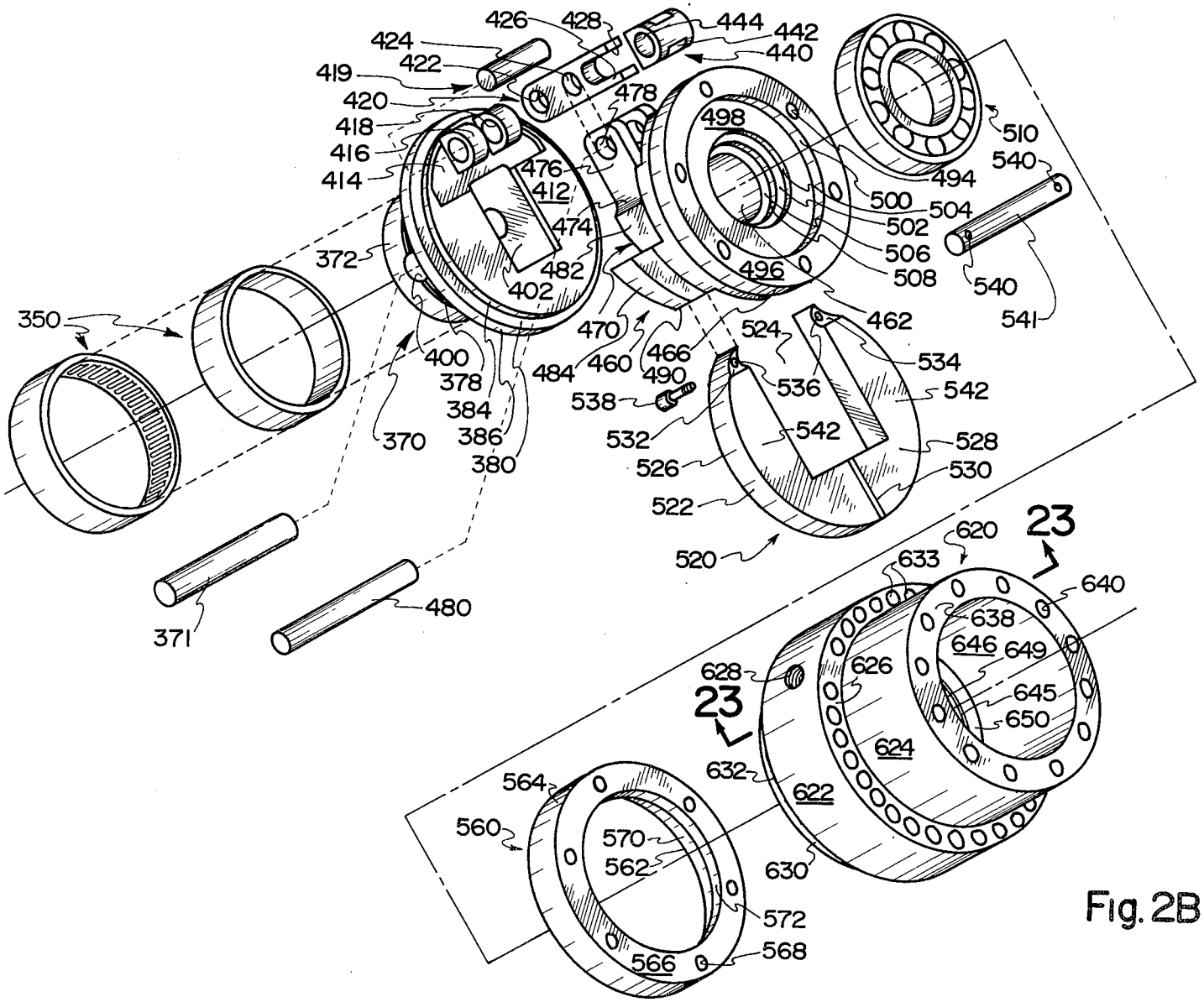

Reference is now made to the drawings wherein like numerals are used to designate like parts throughout. The present invention has utility as a variable displacement transmission-pump and as a transmission-motor. One presently preferred transmission-motor embodiment is illustrated in FIGS. 1 through 25 and is generally designated 10. Motor 10 is illustrated in FIG. 1 connected to the wheel 12 carrying an inflated tire 14 so that the output of the motor 10 power drives the wheel. The motor 10 is illustrated as being connected to a conventional hydraulic fluid delivery system, generally designated 16, comprising a hydraulic reservoir 18 and a hydraulic pump 20. Pump 20 may be a Vickers variable volume hydraulic pump, model U39U7. Pump 20 selectively delivers hydraulic fluid under pressure along line 22 to the rear end cap of the motor 10, while spent hydraulic fluid returns via line 24 to reservoir 18.

Hydraulic pump 20 also selectively delivers via lines 26 and 28 to either side of a piston contained within housings 620 and 670 of the motor 10, with the opposite side of the piston being exhausted of hydraulic fluid.

The hydraulic pump 20 is illustrated as comprising an input drive shaft 30 which, alternatively, may be driven by an internal combustion engine 32, such as a turbine engine, a diesel or gasoline internal combustion engine. Alternatively, the shaft 30 may be conventionally driven by an electrical motor 34 coupled to a source of energy 36 which may be one or more batteries. If desired, the engine 32 and/or the electric motor 34 and source of power 36 may be disposed beneath the hood of an automobile of which wheel 12 may be a part. While hydraulic systems are described, the present invention also applies to pneumatic systems.

Motor 10 (See FIG. 2A) also comprises an outer cylindrical housing 38 comprising an elongated exterior annular surface 39 and an interior smooth annular surface 41. Surface 41 is interrupted by a groove 43 which creates fore and aft shoulders 45 and 47. Groove 43 provides clearance for rotational motion of a wobble plate, as hereinafter explained. A radial threaded bore 49, illustrated as being equipped with a plug or fitting, provides for introduction and removal of hydraulic fluid. The housing 38 adds stability to the motor, but is not essential to the operation thereof.

Figure 3:
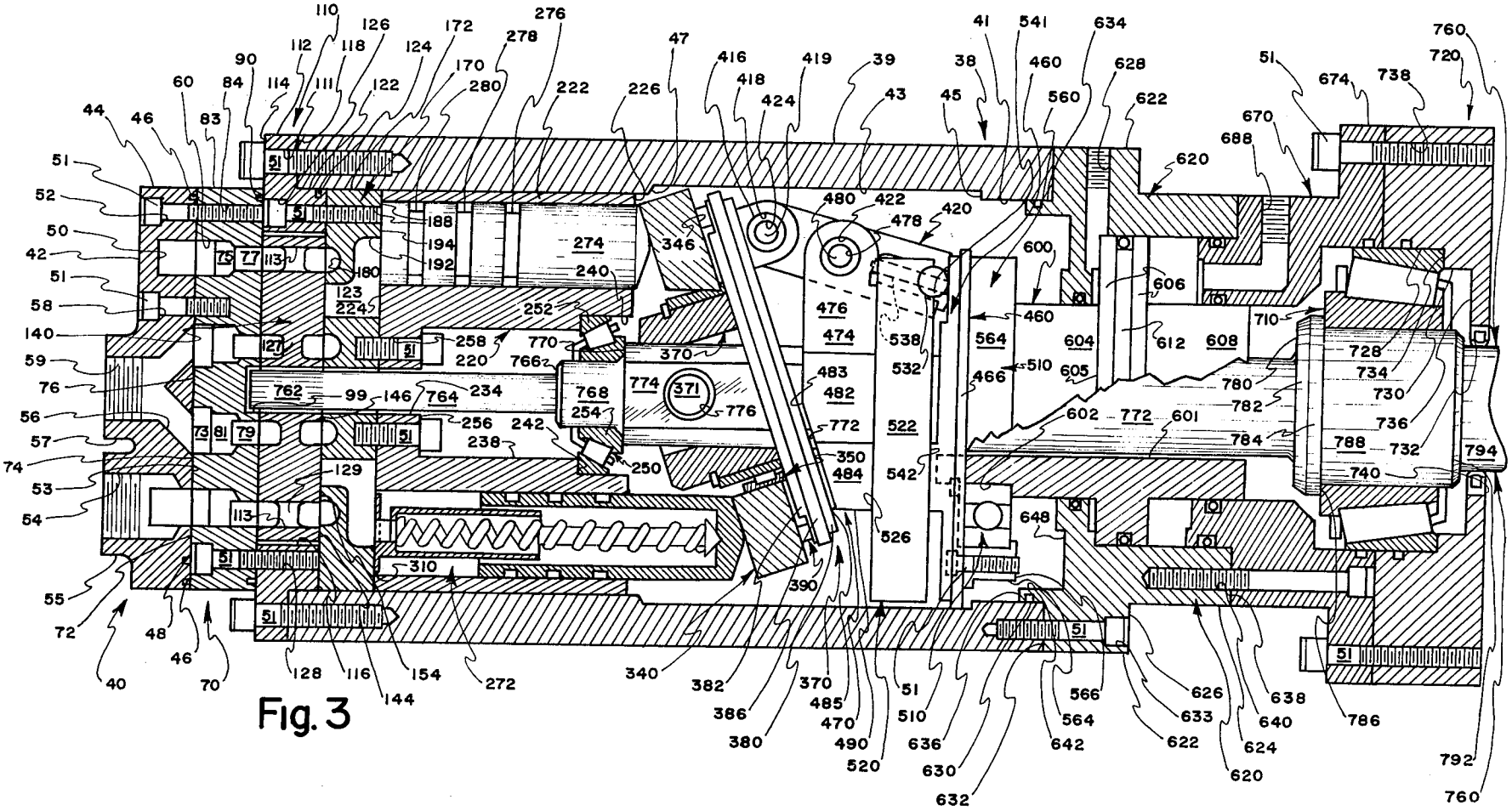
FIG. 3 is an enlarged longitudinal cross section of the fluid drive mechanism of FIG. 1.
Figure 7:
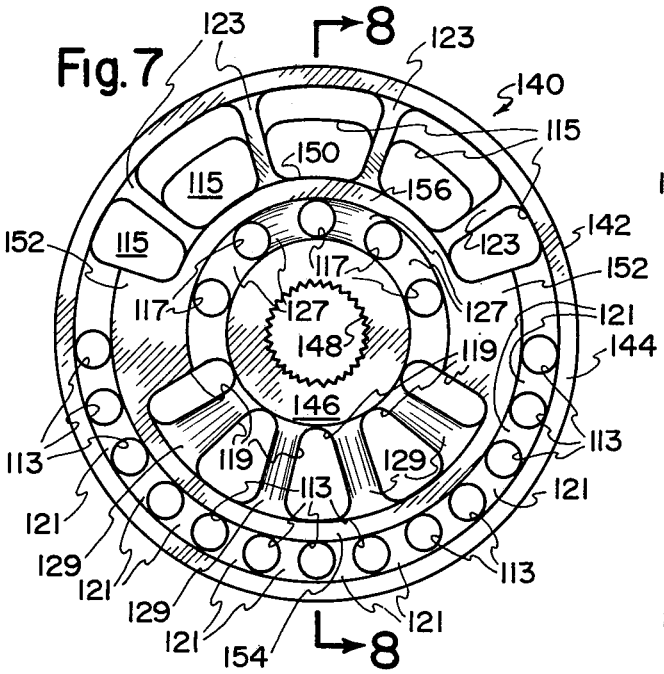
FIG. 7 is an elevation view of the valve of the fluid distributor mechanism of FIG. 1.
Figure 8:
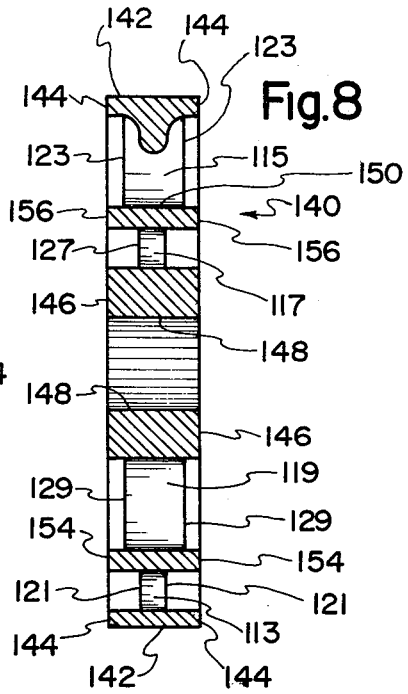
FIG. 8 is a cross section taken along line 8—8 of FIG. 7.
Figure 9:
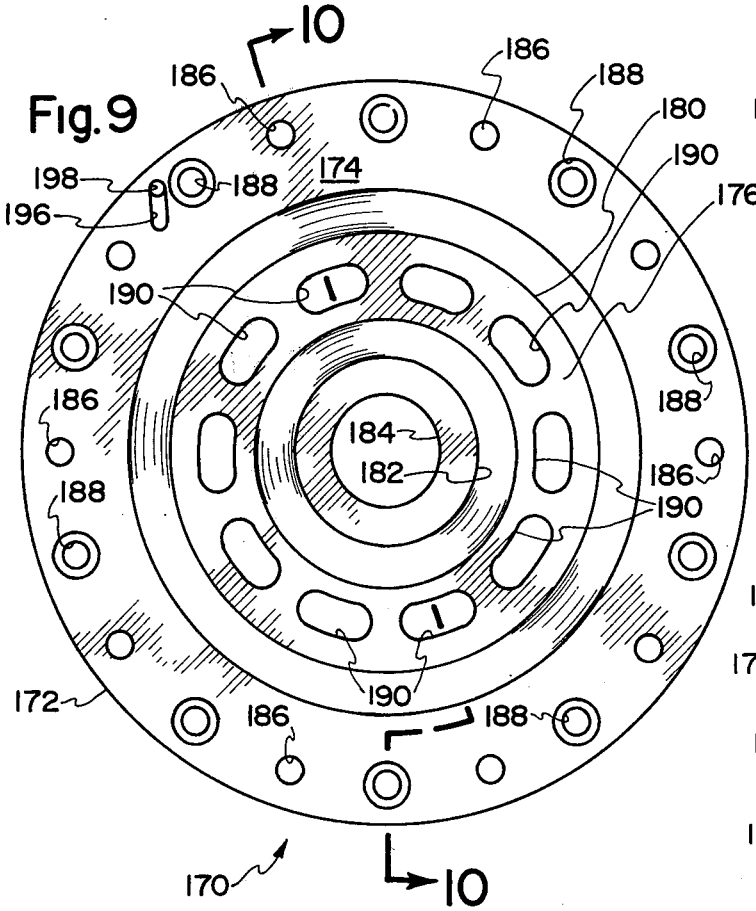
FIG. 9 is a rear elevation of a second distributor plate of the fluid drive mechanism of FIG. 1.
Figure 10:
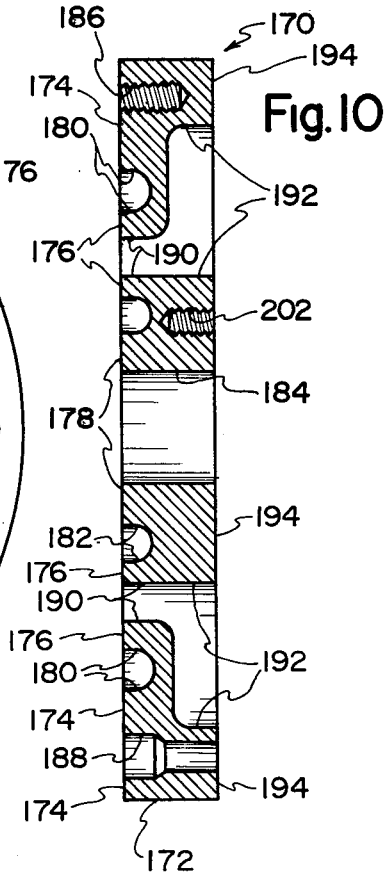
FIG. 10 is a cross section taken along line 10—10 of FIG. 9.
Figure 11:
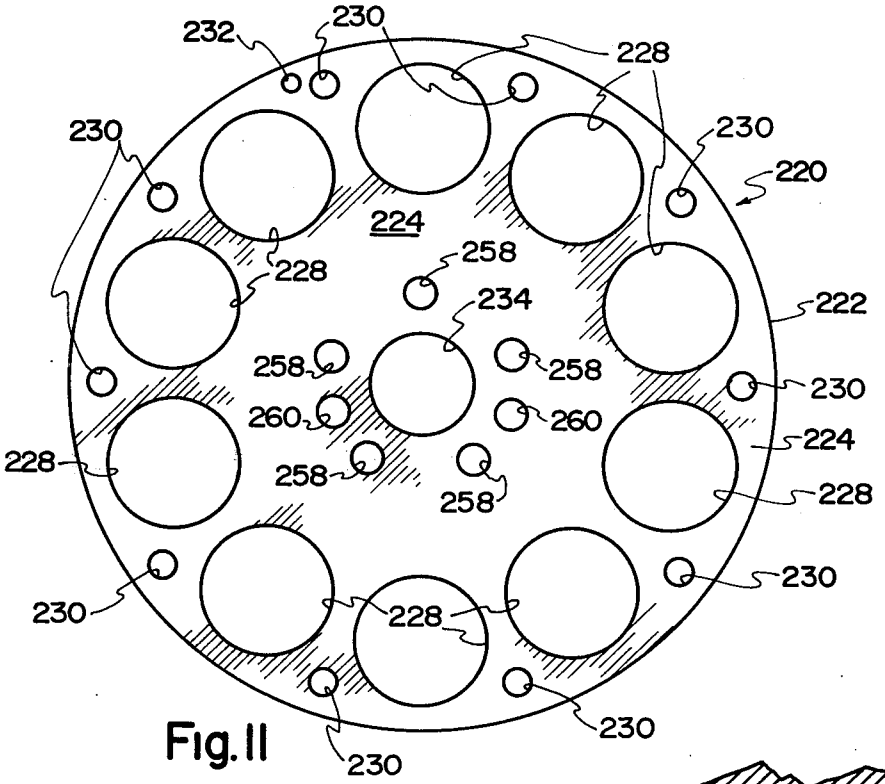
FIG. 11 is a rear elevation of the cylinder housing of the fluid drive mechanism of FIG. 1.
Figure 12:
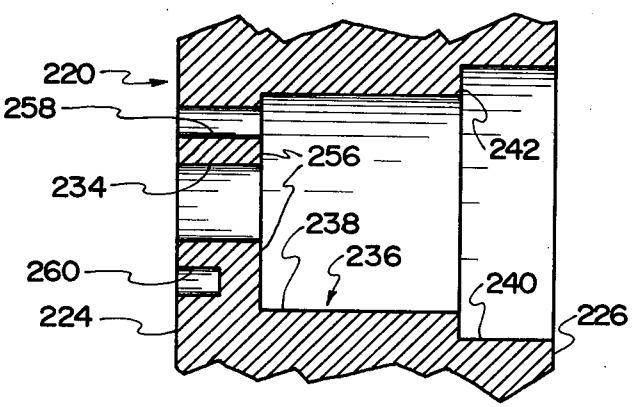
FIG. 12 is an enlarged fragmentary cross section illustrating the stepped interior of the cylinder housing or block of FIG. 11.
Figure 23:
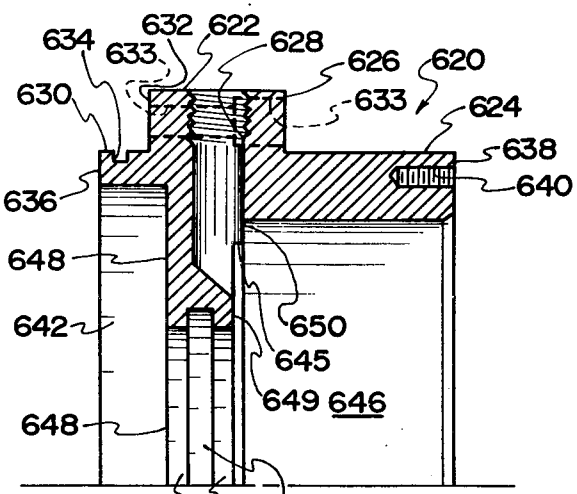
FIG. 23 is an enlarged fragmentary longitudinal cross section of part of the housing for the wobble plate piston.
Figure 24:
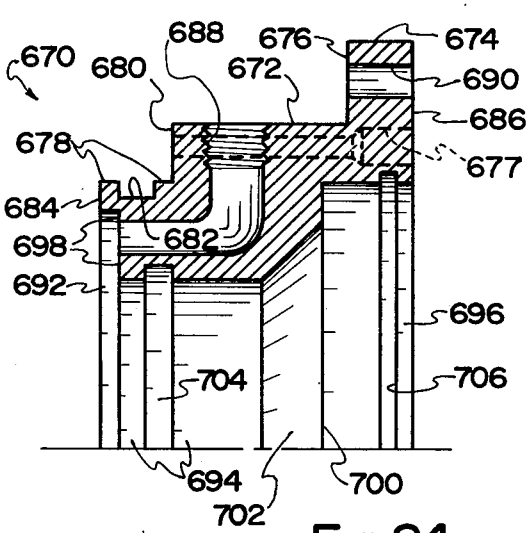
FIG. 24 is an enlarged fragmentary longitudinal cross section of the other portion of the housing containing the wobble plate piston.
Figure 13:
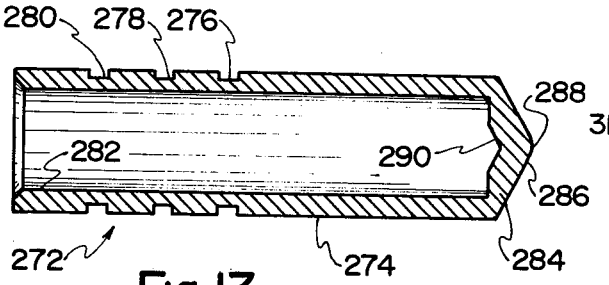
FIG. 13 is a longitudinal cross section of one of the pistons contained within each of the cylinder bores of the cylinder housing.
Figure 14:
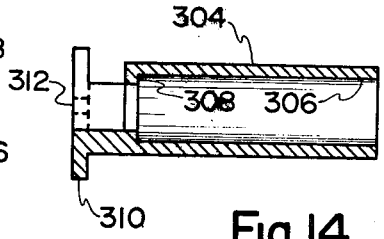
FIG. 14 is a longitudinal cross section of the spring retainer used adjacent each piston spring.
Figure 15:
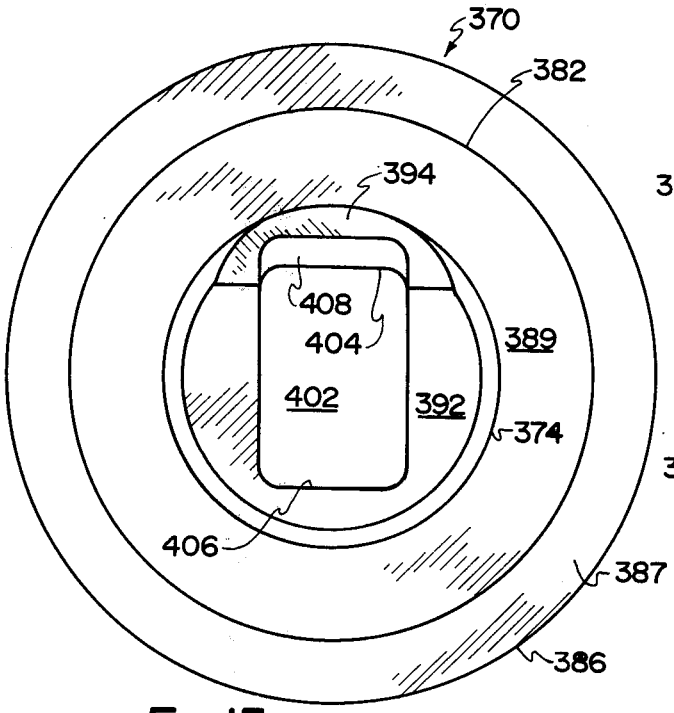
FIG. 15 is a rear elevation view of the wobble plate of the fluid drive mechanism of FIG. 1.
Figure 16:
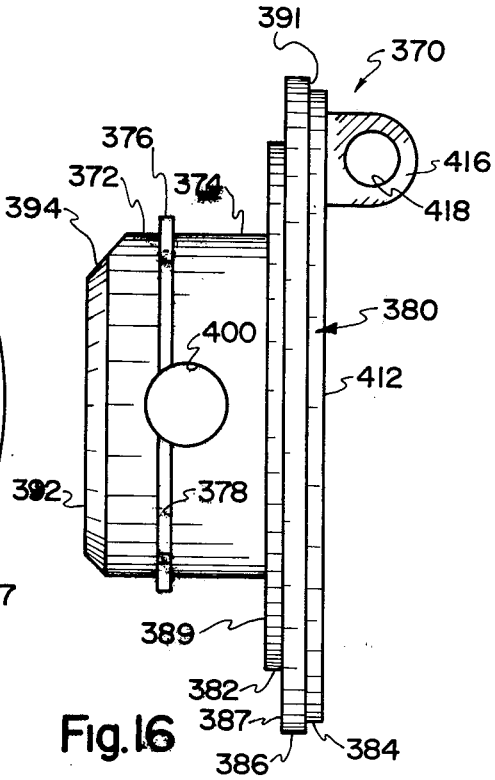
FIG. 16 is a side elevation of the wobble plate.
Figure 25:
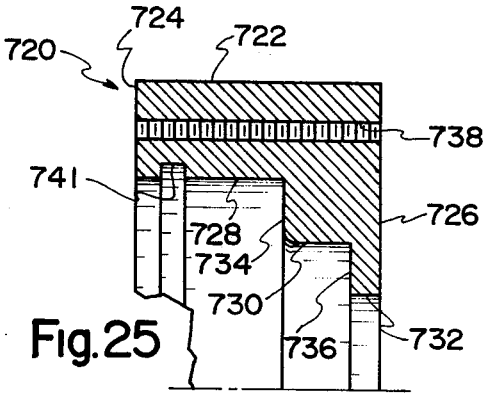
FIG. 25 is an enlarged fragmentary longitudinal cross section of the leading end cap of the fluid drive mechanism of FIG. 1.
Figure 17:
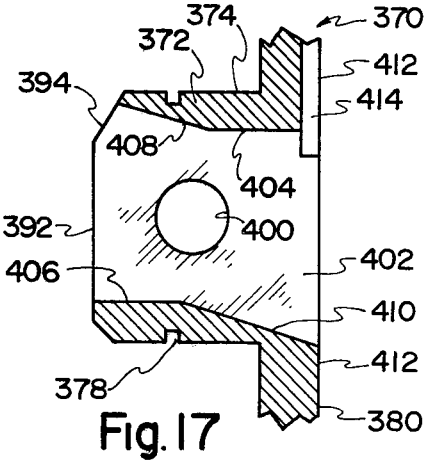
FIG. 17 is a fragmentary cross section of the wobble plate illustrating the interior configuration thereof.

In the interest of brevity let it be stated at this juncture that the various components comprising motor 10 are secured in the assembled condition illustrated in FIG. 3 by cap screws 51 each placed in an axial directed threaded bore, each cap screw being shown to be an Allen-headed cap screw. Also, unless otherwise herein stated, the components of motor 10 are preferably steel.

Motor 10 comprises a stationary end cap 40 (see FIGS. 2A and 3–5), which is generally disc shaped with the exposed exterior radial end 42 being basically smooth, as is the exposed annular edge 44. The interior radial face 53 is interrupted by a manifold comprising outer groove 46 (which receives a sealing O-ring), intermediate groove 48 (which is a return groove for stray hydraulic fluid) and a relatively large inner groove 50 (which is a fluid displacement groove).

A series of counterbores 52 intersect with the base of the intermediate groove 48 and pass through the entire end cap 40 in an axial direction eccentric to the axis of the motor. Each counterbore 52 receives in recessed relation the head and threaded shaft portion of a cap screw 51.

A relatively large eccentric threaded bore 54 spans between the base of the inner groove 50 and the end 42 and serves as a port through which exhaust hydraulic fluid passes from the motor. The exterior exposed portion of the threaded bore 50 comprises a boss 55.

There also exists on face 42 of the end cap 40 a central boss 57, the interior of which comprises a threaded bore 59 through which hydraulic fluid passes to drive the motor. Hydraulic flow through the threaded central port 59 is divided into a plurality of diagonal streams along passageways 56. A second set of cap screws 51 loosely pass through apertures 58, with the heads thereof being exposed at surface 42.

Forward of end cap 40 is a first (trailing) stationary distributor plate 70. Distributor plate 70 comprises an exposed annular surface 83 and a trailing face comprising three concentric radial surfaces 72, 74 and 76 disposed in a common plane and, when assembled, contiguous with end cap 40. (See FIGS. 2A and 5.) The leading face of the plate 70 comprises essentially three concentric radial surfaces 78, 80 and 82. Surfaces 72 and 78 are interrupted by eccentric axially directed counterbores 84. Each counterbore 84 accommodates the recessed placement of an Allen-headed cap screw 51.

Also spanning between faces 72 and 78 are threaded axially directed eccentric bores 86 (aligned with counterbores 52 of the end cap 40) which receive the threaded leading ends of cap screws 51 to thereby firmly join end cap 40 to plate 70, as shown in FIG. 3.

Threaded blind bores 71 are exposed at surface 74 and are aligned with bores 58 of end cap 40 to receive the leading threaded end of additional cap screws 51. A relatively large annular groove 73 (aligned with the leading terminal ends of diagonal passageways 56 of end cap 40) accommodates ingress flow of hydraulic fluid.

Smooth surface 78 is interrupted by two annular grooves 90 and 92, groove 90 receiving an O-ring and groove 92 functioning as a collector for stray hydraulic fluid. Port 94 (FIG. 2A) provides for fluid communication between the hydraulic fluid collector groove 48 of end cap 40 and collector groove 92 of plate 70.

Spanning between the solid material defining the surface 78 and the solid material defining the surface 80 are six spokes 75 radially disposed at sixty degree (60°) intervals. Between each two adjacent spokes is an elongated peanut-shaped opening 96 spanning the entirety of the space between the surfaces 78 and 80. Each opening 96 comprises rounded ends as defined by the spokes 75. The openings 96 axially communicate with grooves 77 and 60 of plate 70 and are aligned with groove 50 and threaded port 54 of end cap 40. Thus, egress fluid flow is substantially unrestricted through openings 96.

Spanning between the solid material defining surfaces 80 and 82 and defining substantially circular apertures 98 are spokes 81. Spokes 81 are disposed at sixty degree (60°) intervals and are radially directed, but are evenly offset from spoke openings 96. The circular openings 98 axially communicate with grooves 73 and 79 of plate 70 thereby accommodating flow of ingress hydraulic fluid. Concentric within surface 82 is a smooth blind bore 99, which rotatably journals the trailing end of a main shaft 760 (yet to be described).

Forward and contiguous with the plate 70 (in the assembled condition) is distributor housing 110. (See FIGS. 2A and 6.) Housing 110 comprises an exposed annular peripheral surface 112, a continuous smooth trailing surface 114 and a smooth relatively large central bore 116.

The forward portion of the housing 110 is stepped, comprising an outside radially directed surface 118 and an inside radially directed surface 120. A shoulder 122 is interposed between the two surfaces 118 and 120. Shoulder 122 defines an annular groove 124 in which an O-ring is disposed when assembled.

A plurality of smooth axially directed bores 111 near the peripheral surface 112 span between the surfaces 114 and 118, through which cap screws 51 loosely pass, with the threaded ends thereof being secured in blind threaded bores 37 at the trailing end of housing 38.

A plurality of relatively large smooth counterbores 126 span between the surfaces 114 and 120 and loosely receive cap screws 51 in concealed recessed relation. A plurality of threaded bores 128 (FIG. 2A) are interposed between each adjacent pair of counterbores 126 along the same radius line and exposed at surface 120 to receive the leading threaded end of cap screws 51.

An eccentric bore 130 (FIG. 2A) also axially spans between the surfaces 114 and 120 in alignment with bore 94 of valve plate 70 for return of stray hydraulic fluid to the main body of hydraulic fluid. Port 132, exposed along the interior surface 116, communicates with bore 130 and thus assists in collecting stray hydraulic fluid. In cases where low speeds are not utilized, e.g. when adjacent parts are recessed or relieved to accommodate high speeds, port 132 has been found to be unnecessary.

High capacity rotating distributor 140 is non-rotatably fastened to the main shaft sized and shaped so as to fit snugly though rotatably within the central opening 116 of the housing 110 and comprises a smooth annular face 142, the diameter of which is almost the same as the diameter of the opening 116. (See FIGS. 2A and 7.) The exterior surface 142 comprises part of a 360 degree peripheral ring 144. Distributor 140 also comprises a 360 degree ring-like intermediate sealing member 150 and an inner ring or boss 146. Rings 144 and 146 and the ring-like member 150 present substantially concentric radial fore and aft smooth surfaces disposed respectively in common radial planes.

A plurality of outside fluid openings 113 and 115 and inside fluid openings 117 and 119 are disposed respectively between the rings 144 and the ring-like member 150 and between the ring-like member 150 and the central boss 146.

The central boss 146 is internally splined at 148 to non-rotatably receive the main shaft 760, which shaft, as mentioned, extends a short distance beyond splines 148 into blind bore 99 of the plate 70.

One set of openings 113 and 115 accommodates hydraulic fluid flow between ring 144 and ring-like barrier 150, while the second set of openings 117 and 119 accommodates hydraulic fluid flow between the ring-like barrier 150 and the boss 146.

A plurality of relatively radial spokes 121 span between the ring-like member 150 and the ring 144 to define the relatively small circular openings 113. A plurality of larger radial spokes 123 span between the ring-like member 150 and ring 144 to define the larger arcuate openings 115. A plurality of short radial spokes 127 span between the ring-like member 150 and the boss 146 to define the small circular openings 117. A plurality of larger radial spokes 129 span between the ring-like member 150 and the ring 146 to define the larger inner openings 119.

The ring-like member 150 comprises a pair of opposed steps 152 at which the diameter of the ring-like member 150 is changed. Accordingly, ring-like member 150 comprises a relatively large diameter arcuate band 154 which merges with or steps into a smaller diameter arcuate band 156 at step sites 152. Accordingly, the radial spokes 121 between portion 154 and ring 144 are relatively short and the spokes 123 between the smaller arc 156 and the ring 144 are longer and fewer in number thereby defining the substantially larger openings 115. The reverse is true regarding the spokes disposed between the larger arcuate portion 154 and the boss 146 and the smaller arcuate portion 156 and the boss 146, respectively.

A second (leading) stationary distribution plate 170 is immediately forward of valve 140 and comprises a smooth exposed annular peripheral surface 172, three concentric smooth rear surfaces 174, 176 and 178 disposed in a common radial plane. (See FIGS. 2A and 8–10.) Surfaces 174 and 176 are separated by an annular groove 180, while surfaces 176 and 178 are separated by a groove 182. Surface 178 defines a central smooth bore 184 through which the main shaft 760 rotatably passes.

A plurality of spaced blind threaded bores 186 are exposed at surface 174, aligned with counterbores 126 of housing 110 and receive the threaded leading ends of cap screws 51 to secure housing 110 to the second plate 170.

A plurality of eccentric counterbores 188 are evenly located between each two adjacent blind bores 186 along the same radius and extend axially through second plate 170 to accommodate recessed receipt of the heads of additional cap screws.

A plurality of radially disposed peanut-shaped ports 190 are exposed at surface 176 and pass axially entirely through second plate 170, each said port progressively changing in cross-sectional configuration (in an axial direction) from said peanut-shape 190 at surface 176 to a bell-shaped configuration 192 at the forward radial face 194 of second plate 170.

Grooves 180 and 182 substantially increase the volume of available hydraulic fluid under pressure which may be caused to pass through the distributor 140 for high speed operation. In short, eccentric grooves 180 and 182 together with the adjacent and aligned grooves in the distributor 140 are dynamic arcuate hydraulic fluid reservoirs which balance or equalize the pressure on each side of the distributor 140 so that it floats and does not bind during operation.

A channel 196 and axial passage 198 (FIG. 9) are also disposed in surface 174 and are located so as to be in fluid communication with passage 130 in valve housing 110. Channel 196 thus communicates stray hydraulic fluid to axial passage 198 in second plate 170.

The axial enlargement of peanut-shaped passages 190 into bell-shaped openings 192 is for the purpose of properly displacing and locating hydraulic fluid under pressure into position to drive pistons of the motor/pump in a manner and for purposes hereinafter more fully described.

Forward radial surface 194 also comprises pairs of blind bores 200 disposed above and between each two adjacent bell-shaped openings 192, for purposes yet to be more fully described.

Diametrally interior of the bell-shaped openings 192 at surface 194 is a ring of five threaded blind bores 202, which receive the leading threaded ends of cap screws 51 for the purpose of holding the assembly together.

Adjacent to and at substantially the same radial distance from the longitudinal axis of the motor/pump are two relatively large smooth blind bores 204 to receive the ends of dowel pins used to align the contiguous parts of the assembly.

The ingress and egress fluid passageways, as described, through end cap 40, plate 70, distributor 140 and plate 170 accommodate fluid displacement to a piston assembly without substantial reduction in pressure and without substantial restriction in flow. Thus, full fluid force exists at the piston assembly and fluid flow is substantial and continuous. As explained later in more detail, the rotating distributor cyclically passes a vortical or helical sweep of fluid to successive segments of the piston assembly.

Forward of second plate 170 is cylinder housing 220. (See FIGS. 2A, 11 and 12.) The cylinder housing or block 220 comprises a relatively long annular peripheral surface 222, a rear planar radial face 224 and a forward planar radial face 226. The cylinder housing 220 defines a ring of ten side-by-side cylinder bores 228, which are eccentric to but parallel with the longitudinal axis of the housing. The cylinder bores 228 have a common radius and are of identical diameter and length.

Adjacent the annular exposed surface 222 at face 224 are a plurality of blind threaded bores 230, in alignment with counterbores 188, which receive the leading threaded ends of cap screws 51 to hold the assembly together. A relatively small eccentric passage 232 extends axially through the entire length of the cylinder housing 220 and is positioned so as to communicate with passage 198 of second plate 170 to accommodate return of stray hydraulic fluid.

The cylinder housing 220 also defines a small diameter central smooth circular opening 234 at the trailing end through which the main shaft 760 rotatably passes. The opening 234 is part of a stepped bore 236, having an intermediate interior annular surface 238 and a large leading annular surface 240 which opens at surface 226. A shoulder 242 is interposed between the annular surfaces 238 and 240. The annular surface 240 receives the outer race 252 of bearing 250 in press fit relation such that the base of the outer race 252 also rests against shoulder 242. The inner race 254 is press fit upon and, therefore, is non-rotatably secured to the main shaft 760.

The inwardly directed radial flange 256 defines the opening 234 and comprises five smooth bores 258 (in alignment with threaded blind bores 202) through which cap screws 51 loosely pass to secure the second plate 170 to the cylinder housing 220. In addition, two smooth blind bores 260 in flange 256 are exposed at surface 224 and receive dowell pins which span between blind bores 260 of cylinder housing 220 and blind bores 204 in face 194 of the second plate 170 so that proper alignment is initially established and maintained.

Each cylinder 228 of housing 220 contains a piston assembly, generally designated 270. (See FIGS. 2A, 13 and 14.) Each piston assembly comprises a piston 272, which comprises a hollow cylindrical shell or head 274 in the exterior of which are disposed three radial fluid receiving grooves 276, 278 and 280. The trailing end of the cylindrical shell 274 defines an opening 282 the diameter of which is the same as the hollow interior of the cylindrical shell 274. The cylindrical shell 274 is closed at its leading end by an end cap 284. End cap 284 comprises an exterior conical surface 286 which terminates in central spherical tip 288, which may be of a material highly resistant to impact and wear.

The interior surface of the closure 284 comprises a central conical recess 290 which is coaxial with the piston 272.

Each piston assembly 270 further comprises a bias assembly 300, which includes a coiled hollow compression spring 302 having sufficient strength to urge the piston 272 at all times toward its extended position. The trailing end of spring 302 is contained within a cylindrical alignment housing 304. The alignment housing 304 is hollow and presents a forward opening 306 equal in diameter to the hollow interior of the housing 304 and slightly larger than the diameter of spring 302.

The rear of the spring alignment housing 304 comprises an abutment flange 308 against which the trailing end of the spring 302 rests when assembled. The alignment housing 304 is properly assembled by mounting the trailing flange 310 to the face 194 of the second plate 170 utilizing press fit fasteners through apertures 312 in the flange 310 which are forced into adjacent pairs of the blind bores 200 on opposed sides of each bell-shaped opening 192 of plate 170.

The bias assembly 300 also comprises a centering mechanism 320. Centering mechanism 320 comprises a shaft 322 of uniform diameter throughout which is slightly less than the inside diameter of the spring 302, and an enlarged head 324 comprising a radial flange 326, larger in diameter than the outside diameter of the spring 302, and a conical forward projection 328, sized and shaped to precisely fit within the conical recess 290 of closure 284 of the piston 272. The shaft may be either hollow or solid. Thus, when the piston 272 is superimposed over the alignment mechanism 320 and the shaft 322 of the centering mechanism 320 is caused to be received within the interior of the spring 302 and the base of the spring 302 is positioned within the alignment housing 304 in proper assembled relation, the piston 272 is urged in a forward direction and its alignment within the adjacent cylinder 228 is established and maintained.

The spherical tip 288 of each of the array of ten pistons 272 by reason of the force of the associated bias assembly 300 is urged into firm contiguous relation with the rear radial face 342 of an annular abutment plate 340. The outside annular peripheral surface 344 of abutment plate 340 is not contiguous with any other part. (See FIG. 3.) The abutment plate 340 further comprises a leading radial surface 346 and an interior annular surface 348 defining the interior opening which receives a conventional needle bearing assembly 350 in press fit relation.

The needle bearing assembly 350 is rotatably carried upon the exterior cylindrical surface 374 of a rearward projection 372 of a wobble plate assembly 370, allowing oscillations of plate 340 (due to impact of the pistons thereagainst) to cause the plate assembly 370 to rotate. (See FIG. 2B.) The inner race of the needle bearing assembly 350 is secured on the indicated surface 374 by a snap ring 376 disposed in groove 378. (See FIG. 16.)

The wobble plate 370 comprises an enlarged stepped flange 380 which defines annular edges 382, 384 and 386. (See FIGS. 2B, 15, 16 and 17.) A needle thrust bearing 390 rides upon annular edge 382 contiguous with shoulder 387 and also abuts surface 346 of abutment plate 340. The needles of bearing 390 also engage surface 346 of plate 340. (See FIG. 2A.) Thus, angular wobble plate 370 may rotate with the main shaft and the abutment plate 340 is caused to be maintained in an oscillating, floating condition.

The axial projection 372 terminates in a radial end 392 which merges with an elevated diagonal face 394. Face 394 is interposed between the radial surface 392 and the cylindrical surface 374 of the projection 372. The diagonal surface 394 accommodates changing of the angle of inclination of the wobble plate to any one of several angular positions up to the maximum angle without creating an interference involving the bearing 250. It is to be appreciated that wobble plate 370, to operate, must have some angle of inclination.

The wobble plate 370 comprises angularly disposed power transmitting structure and is non-rotatably secured to the main shaft 760 by a cross pin 371 passing through bushings in a pair of aligned apertures 400 disposed in the projection 372. The wobble plate 370 comprises a central passageway 402 (FIG. 17) which is substantially rectangular in cross-section at any point and comprises top and bottom offset axial surfaces 404 and 406 together with trailing top and leading bottom tapered surfaces 408 and 410. The tapered surfaces 408 and 410 are sized and shaped to accommodate the previously mentioned change in the angle of inclination of the wobble plate 370. The forward radial surface 412 of the flange 380 comprises a recess 414 wherein material has been removed to balance the wobble plate 370.

The wobble plate 370 also comprises a pair of spaced clevis lugs 416 projecting from recess 414 of flange 380, each lug 416 having an aperture 418, said apertures 418 being aligned one with another and containing a bearing or bushing for journaling a pin 419, which connects a link 420 to the clevis lugs 416.

Link 420 is substantially rectangular in cross-section and comprises a trailing aperture 422 through which said pin 419 rotatably passes. Bore 422 receives a bearing or bushing to accommodate rotational connection with pin 419.

Link 420 aids in setting and thereafter adjusting the angle of inclination, of the wobble plate 370. Link 420 comprises further a central crossbore 424 and defines a forwardly projecting fork comprising fingers 426 which define a U-shaped slot 428 between them. The fingers 426 reciprocably carry a sliding connector 440. Fore and aft displacement of the connector 440 is permitted because the fingers respectively are disposed in U-shaped grooves 442 top and bottom on the connector 440.

Otherwise, the connector 440 is a block of metal, such as brass, having a crossbore 444 disposed therein for pin connection to a counterweight used to adjust the amount of counterbalance depending upon the angle of inclination of the wobble plate 370, in a fashion hereinafter more fully explained.

Forward of the wobble plate 370 is actuator 460. (See FIGS. 2B, 18, 19 and 20.) The main shaft 760 snugly but rotatably passes through the brass bushing 464 disposed in the central aperture 462 of the actuator 460; however, actuator 460 rotates with the main shaft 760 by reason of being non-rotatably connected by link 420 to wobble plate 370 as will hereinafter be more fully explained.

Figure 18:
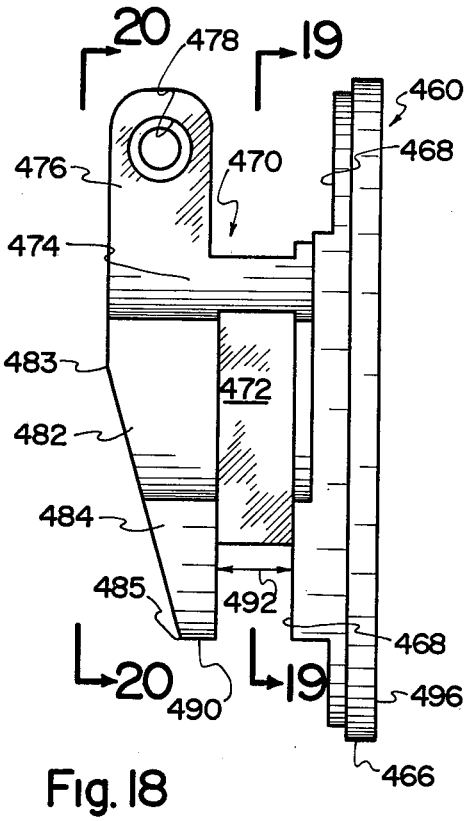
FIG. 18 is an enlarged side elevation of the actuator of the fluid drive mechanism of FIG. 1.
Figure 19:
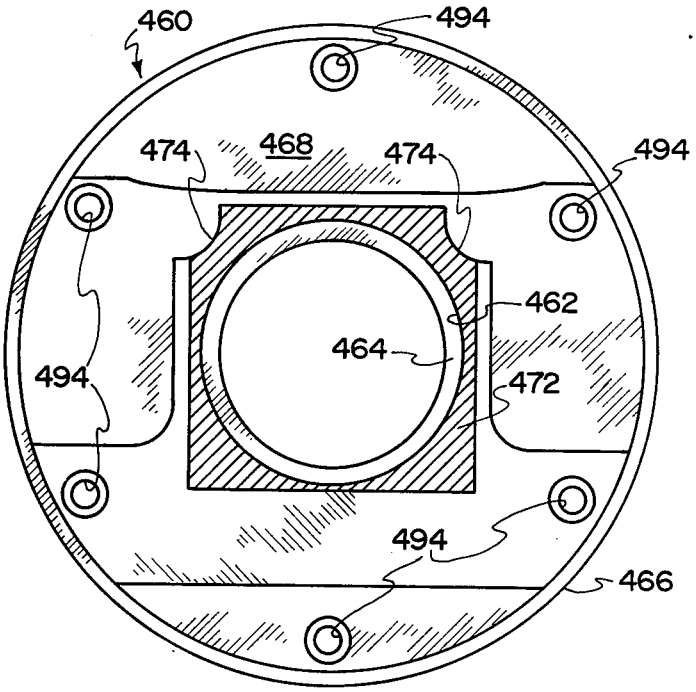
FIG. 19 is a cross section of the actuator taken along line 19—19 of FIG. 18.
Figure 20:
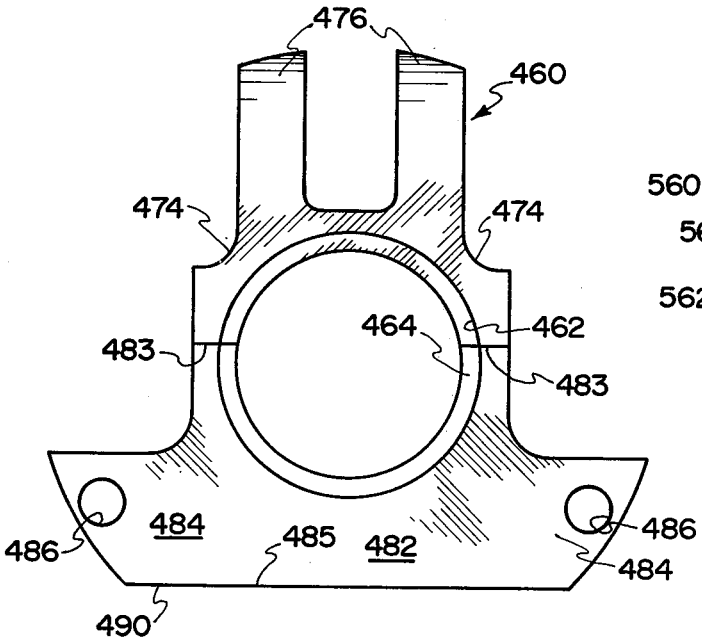
FIG. 20 is a rear elevation view taken along line 20—20 of FIG. 18.
Figure 21:
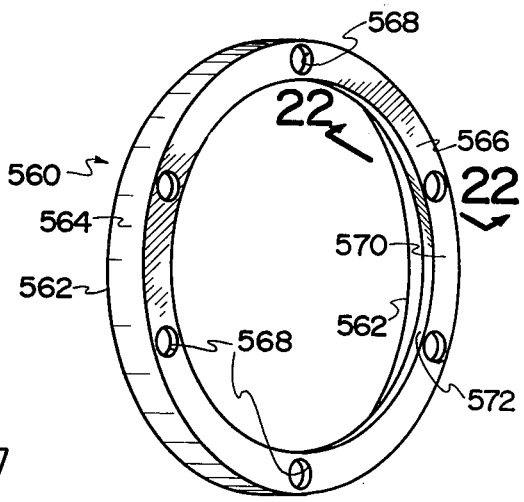
FIG. 21 is a perspective representation of a bearing retainer of the fluid drive mechanism of FIG. 1.
Figure 22:
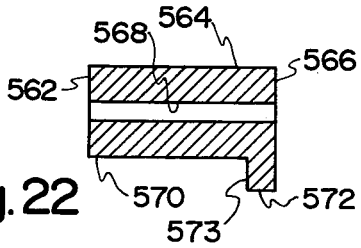
FIG. 22 is an enlarged fragmentary cross section taken along line 22—22 of FIG. 21.

The actuator 460 comprises an enlarged annular flange 466, the back side 468 of which is configurated and contoured to provide for clearance and weight reduction. Projecting rearward from and integral with the flange 466 is a centrally disposed hollow projection 470. The projection 470, as best seen in FIGS. 18–20, comprises (in cross-section) a substantially rectangular neck 472. However, the two elevated corners 474 are concave.

The trailing portion comprises an upwardly extending clevis having legs 476 which contain aligned apertures 478 which are spaced and sized so as to receive bearings or bushings through which a locking pin 480 rotatably passes. The locking pin 480 also passes rotatably through a bearing or bushing contained within bore 424 of the link 420 so that axial displacement of the actuator 460 will displace the link 420 to thereby adjust the angle of inclination of the wobble plate 370.

The clevis lugs 476 of the projection 470 of actuator 460 merge into a central body portion 482 through which the central aperture 462 also passes. Body portion 482 further comprises an extension of said corner concavities 474 and presents a pair of opposed outwardly directed lugs 484, each of which contains a bore 486. The body portion 482, as best seen in FIG. 18, is tapered from a location 483 near the center of the opening 462 in a forward direction to a location 485 to create a relatively narrow edge 490 at the base thereof.

Edge 490 is spaced from the adjacent rear wall 468 of the flange 466 by a distance 492. In this fashion, a groove is created for receiving a vertically reciprocable counterweight 520, in a manner and for a purpose yet to be explained.

The actuator 460 at flange 466 comprises six counterbores 494 extending entirely through the flange 466 to receive in recessed relation Allen-headed cap screws 51 to secure adjacent parts firmly one to the next.

The forward face of the actuator 460 is stepped and comprises an outer radial surface 496 (FIG. 2A) through which said counterbores 494 pass in eccentric though axial orientation. The face 496 merges with a recessed intermediate radial surface 498 across shoulder 500. In turn, surface 498 merges with radial surface 502 across shoulder 504. Radial surface 502 merges with interior radial surface 506 across shoulder 508. Accordingly, said surfaces 496, 498, 502, and 506 comprise offset eccentric radially directed surfaces. Surface 498 and shoulder 500 accommodate receipt of conventional ball bearing assembly 510 along the outer race thereof. The surface 502 provides clearance for a snap ring which retains a piston accommodated by the space provided by surface 506 and shoulder 508, in a manner hereinafter more thoroughly explained.

Counterweight 520 (FIG. 2B) is generally U-shaped when viewed from either face and comprises a radial edge 522 which traverses approximately 330 degrees but defines an opening or slot 524 at the top of the counterweight 520. Counterweight 520 also comprises a smooth back surface 526 and a smooth forward surface 528 which is interrupted by a vertical channel 530 disposed centrally below the opening 524. The forward surface 528 is also interrupted adjacent the top of opening 524 by a pair of transverse concavities 532 and 534 which are identical though opposite hand.

Axially disposed in each concavity 532 and 534 is an axial bore 536. Each opening 536 accommodates receipt of a relatively small cap screw 538, the leading end of which thread into threaded bores 540 of pin 541 to anchor the counterweight to the pin which in turn is anchored to the wobble plate 370 through link 420 and slidable connector 440. Specifically, pin 541 passes through a bearing or bushing disposed in aperture 444 of connector 440 and, therefore, counterweight 520 is elevated and lowered by advancement and retraction of the link 420 and connector 440.

The counterweight 520 can be considered as comprising a pair of legs 542 which define the central rectangular opening 524. The opening 524 is sized and dimensioned so as to be vertically reciprocably disposed within the space 492 of the actuator 460 with the vertical walls defining the opening 524 substantially slidably contiguous with the sides of the rectangular neck 472. Thus, the counterweight 520 is essentially vertically reciprocable which may be elevated until the base of the opening 524 is contiguous with the base of the rectangular neck 472 of the actuator 460. Trapped hydraulic fluid escapes along channel 530.

Thus, as the angle of inclination or orientation of the wobble plate 370 is changed, the location of the counterweight 520 is correspondingly altered, the wobble plate 370 and the actuator 460 together with the counterweight 520 simultaneously rotating with the main shaft 760. At all times the weight of that which is rotated, namely the wobble plate 370, actuator 460 and the counterweight 520 is balanced and vibration thereby is avoided.

Conventional ball bearing 510 (FIG. 2B) is retained contiguously adjacent surface 498 and shoulder 500 by a bearing retainer 560. (See FIGS. 2B, 21 and 22.) Bearing retainer 560 comprises a rear radial face 562 (which is caused to be contiguous with face 496 of actuator 460 in the assembled position), an annular edge 564 and a forward radial face 566. A plurality of eccentric threaded axially directed bores 568 extend between faces 562 and 566 in alignment with bores 494 to receive assembling cap screws 51. The bearing retainer 560 also comprises a stepped central opening comprising annular wall 570 and an interiorly directed radial flange 572 providing a shoulder 573 between wall 570 and flange 572.

As mentioned, the motor 10 comprises an interior reciprocal piston, generally designated 600. (See FIG. 2C.) The piston 600 comprises a central circular opening 601 through which the main shaft 760 rotatably passes. The opening 601 has a uniform diameter throughout. The exterior of the piston 600 comprises a plurality of stepped annular surfaces 602, 604, 606 and 608. The annular surface 602 defines an annular groove 610 in which a snap ring is placed after the surface 602 is extended through the inner race of the ball bearing 510 to retain the bearing upon the surface 602 of the piston 600.

The surface 604 aids (in conjunction with a housing yet to be explained) in creating a fluid seal. The annular surface 606 is interrupted by relatively large annular groove 612 into which a relatively large O-ring is placed for hydraulic seal purposes. Annular surface 608 also aids in creating appropriate fluid seals, as will hereinafter more fully be described.

The double acting piston 600 is reciprocably retained within cylinder housing 620. (See FIGS. 2B and 23.) Housing 620 exteriorly comprises stepped annular surfaces 622, 624 and 630 separated respectively by shoulders 626 and 632. A threaded two way hydraulic port 628 is exposed at surface 622 through which hydraulic fluid under pressure is caused to pass when it is desired to displace the piston 600.

A plurality of counterbores 633 eccentric to but parallel with the axis of the motor extend between shoulders 626 and 632 to receive cap screws 51 for securing adjacent parts one to another in fluid tight relation. The annular peripheral surface 630 comprises an annular groove 634 in which is placed an O-ring to seal the cylindrical housing 620 to the main housing 38. (See FIG. 3.)

The cylinder housing 620 (FIG. 23) further comprises a rear radial trailing surface 636 and a forward radial surface or edge 638. A plurality of threaded blind bores 640 are exposed at surface 638 and accommodate receipt of the leading threaded ends of additional cap screws 51 for securing the assembly together.

The interior of the cylinder housing 620 is also stepped and comprises annular surfaces 642, 644, 645 and 646. A rear radial shoulder 648 is thus defined between surfaces 642 and 644, a forward radial shoulder 650 between annular surfaces 645 and 646 and a forward radial shoulder 649 between annular surfaces 644 and 645.

The annular surface 642 together with shoulder 648 defines a recess in which the bearing retainer 560 is received. The surface 644 is interrupted by relatively large annular groove 652 which contains an O-ring to create a hydraulic seal with surface 604 of piston 600. Surface 606 of piston 600 reciprocates adjacent surface 646 with the O-ring contained within groove 612 creating a fluid seal with surface 646. A space created between shoulder 649 and annular surface 645 of cylindrical housing 620 and shoulder 605 and annular surface 604 of piston 600 communicates with hydraulic port 628 and acts as a hydraulic buffer.

Contiguously secured to the forward surface 638 of cylinder housing 620 is housing 670. (See FIGS. 2C and 24.) Housing 670 attaches to the end of cylinder housing 620 and thereby constricts the forward end of piston 600. Housing 670 comprises exterior annular surfaces 672 and 674 which are separated by a shoulder 676. The housing 670 further defines an annular surface 678, which projects into the housing 620 and is separated from annular surface 672 by a radial shoulder 680, the surface 678 being interrupted by a central exposed annular groove 682. An O-ring is disposed in groove 682 and creates a fluid seal with interior annular surface 646 of cylinder housing 620, with shoulder 680 contiguously engaging edge 638 of housing 620.

The housing 670 also comprises a radial rear surface 684 and a forward radial surface 686. A two way hydraulic threaded port 688 through which fluid under pressure is caused to flow (to selectively displace the piston 600) is exposed at annular surface 672. A plurality of bores 690 which are parallel to but eccentric from the axis of the housing 670 near peripheral annular surface 674 extend between surfaces 676 and 686 to receive cap screws 51 for securing the assembly together. Eccentric though axial bores 677 extend between surfaces 680 and 686 in alignment with blind bores 640 of housing 620, and receive assembling cap screws 51 in recessed relation.

Along the inside, housing 670 comprises stepped interior annular surfaces 692, 694 and 696. A radial shoulder 698 thus exists between surfaces 692 and 694 and a radial shoulder 700 together with a diagonal face 702 are serially interposed between the surface 696 and 694.

Surface 692 together with shoulder 698 provides clearance for the piston 600 and for flow of hydraulic fluid. Surface 694 is adjacent surface 608 of piston 600 when assembled and accommodates reciprocation of piston 600. Surface 694 is interrupted by a groove 704 in which an O-ring is disposed which creates a fluid seal with piston surface 608. Diagonal surface 702 provides for main shaft clearance, while surface 696 together with shoulder 700 accommodates press fit receipt of the outside race of conventional tapered roller bearing 710. (See FIG. 2C.) The interior race of tapered roller bearing 710 is press fit upon the main shaft 760.

The surface 696 is interrupted by a groove 706 which receives an O-ring to create a fluid seal against the outer race of the tapered roller bearing 710.

It is to be understood that abutment plate 340, wobble plate 370, links 420 and 440, counterweight 520, and actuator 460 and piston 600 or other structure for changing the orientation of plate 370 together comprise power transmitting structure in the nature of a wobble plate assembly.

The bearing 710 is held within the indicated position coextensive with annular surface 696 of housing 670 by forward end cap 720. (See FIGS. 2C and 25.) End cap 720 comprises an exterior annular peripheral surface 722, a rear radial edge or face 724 and a front exposed radial face 726. The interior (FIG. 25) comprises stepped annular surface 728, 730 and 732. A radial shoulder 734 separates surfaces 728 and 730. A radial shoulder 736 separates surfaces 730 and 732. A plurality of threaded bores 738 extend between surfaces 724 and 726 to receive assembling cap screws 51.

As shown in FIG. 3, part of the outer race of bearing 710 is disposed contiguous with the interior annular surface 728 and against shoulder 734. The annular surface 730 and shoulder 736 provide clearance for the bearing 710 while the annular surface 732 secures an oil seal 740 between end cap 720 and the main shaft. Annular groove 741, disposed in surface 728 receives an O-ring which seals against the outer race of bearing 710.

The main shaft (FIG. 2C), generally designated 760, is preferably formed of hard steel and is journaled in the earlier described bearings for aligned rotation. Shaft 760 comprises seriatum (from left to right) trailing radial end 798, an annular spline surface 762, a smooth annular shaft portion 764 of relatively small diameter, a radial shoulder 766, an enlarged smooth annular surface 768, a radial shoulder 770, and a further enlarged smooth annular surface 772, which is interrupted at the trailing end thereof by a pair of opposed flats 774 for non-rotatably securing the wobble plate 370 to the main shaft by use of pin 371 (FIG. 3) through shaft aperture 776 extending radially between the flats 774 (and through apertures 400). The shaft 760 further comprises seriatum (left to right) an enlargement 778 which joins the forward end of annular surface 772 and comprises a radial shoulder 780, a diagonally tapered face 782, an annular exposed surface 784, and a radial shoulder 786, the main shaft further comprising a reduced diameter annular surface 788 (joined by an annular filet 790 to the flange 778), a radial shoulder 792 and a diametrically reduced annular surface 794 having a key way 796 and a radial forward end 800, comprising a power take-off for being non-rotatably coupled to a mechanism to be driven.

Annular spline surface 762 of the main shaft non-rotatably connects to the annular interior spline surface 148 of valve 140. Annular surface 764 extends rotatably through the central openings of second valve plate 170 and cylinder housing 220. Annular surface 768 non-rotatably receives the inner race 254 of bearing 250.

Annular surface 772 extends rotatably (with the exception of wobble plate 370) through abutment plate 340, bearing 390, wobble plate 370, actuator 460, counterweight 520, piston 600, cylinder housing 620, and housing 670. Flats 774 are substantially contiguous with the vertical interior surfaces of the opening 402 of wobble plate 370 to thereby join the wobble plate non-rotatably to the main shaft 760.

Enlargement 778 assumes the thrust of the entire motor during operation. Annular surface 788 non-rotatably receives in force-fit relation the inner race of bearing 710, while the annular surface 794 receives the oil seal 740 and is exposed for driving an external mechanism.

From the foregoing it should be readily apparent that stray hydraulic fluid is collected and communicated [from left to right as viewed in the Figures] beginning with annular groove 48 of end cap 40, thence along axial bore 94 of valve plate 70, thence in annular groove 92 of valve plate 70, thence along axial bore 130 of valve housing 110 (with feeder port 132 of valve housing 110 further communicating stray fluid to axial bore 130), thence along axial bore 198 and lateral slot 196 of the second valve plate 170, and thence along axial bore 232 of the cylindrical housing 220 into the interior of the outer cylindrical housing 38 adjacent inner groove 43 thereof.

To operate the assembled hydraulic motor 10, the hydraulic pump 20 is actuated so that a selected amount of hydraulic fluid is introduced under pressure through either line 26 or line 28 with hydraulic fluid being exhausted to the pump 20 through the other of the two lines. In this way, the angle of inclination of abutment plate 340 and wobble plate 370 are set, as hereinafter more fully explained. The wobble plate 370 and associated structure function as a gearless transmission and, therefore, the angle of inclination which controls the speed and power of the output shaft 760 may be instantaneously controlled and changed as desired.

At the same time hydraulic fluid under pressure is issued from pump 20 along hydraulic line 22 and is introduced into the motor at port 59 and thence along the diagonal passageways 56 of the stationary end cap 40. Thereafter, ingress fluid is displaced into groove 73, across spokes 81 at openings 98 and into groove 79 of stationary first plate 70. Thence the fluid is displaced across the large capacity distributor 140 at openings 117 and 119 between spoke sets 127 and 129, respectively.

Distributor 140 is non-rotatably connected to and turns with the main shaft 760. The fluid passing through openings 117 fills groove 182 of second plate 170 and thereby equalizes the pressure disposed on both sides of the distributor 140 allowing it to freely rotate with the shaft 760 without binding. Fluid through openings 119 passes vortically into the adjacent four or five openings 190 in the second plate 170 to selectively drive the axially aligned ones of the piston assemblies 270. This is a dynamic event so that the four or five adjacent openings 190 continually change as the large capacity full flow distributor 140 rotates with the main shaft in regard to the stationary second plate 170 and the stationary cylinder housing 220.

Thus, four or five piston assemblies 270 are extended under pressure at any one point in time but each piston assembly 270 is successively actuated by the pressure of ingress fluid displaced through the openings 119. The mentioned piston actuating ingress fluid, extending four or five piston assemblies 270 simultaneously, reaches the piston assemblies by entering peanut-shaped openings 190 in the second plate 170 and exiting through the enlarged bell-shaped openings 192.

Each bell-shaped opening 192 is in direct alignment with one and one only of the cylinder bores 228 of the cylinder housing or block 220. As the pressurized fluid is introduced into a given cylinder bore 228, the adjacent piston 272 is filled and caused to be advanced and exert a rotational force against the abutment plate 340, which oscillates causing rotation of the wobble plate 370 and the main shaft 760 which is non-rotatably attached to the wobble plate 370.

Once a given cylindrical bore 228 is no longer in communication with any of the openings 119 (across passageways 190–192 of plate 170) and instantaneously thereafter is in communication with the openings 115 (across passageways 190–192 of plate 170), the mentioned cylinder bore 228 commences its exhaust cycle. It should be remembered that the small outside openings 113 accommodate passage of fluid into the groove 180 of the second plate 170 to aid in equalizing the pressure on the high capacity plate 140, the source of the hydraulic fluid being that fluid exhausted from the cylinder bores 228 (four or five). Spent hydraulic fluid issuing from piston-containing cylinder bores 228 will pass to the aligned openings 115, through the adjacent bell-shaped openings 192 and the peanut-shaped openings 190 of the second plate 170 in order to reach the openings 115 and thence into the annular groove 77, through the openings 96 and into the annular groove 60 of the first plate 70 and thence into the annular groove 50 and out the egress port 54 of the end cap 40 into return line 24 from which the spent hydraulic fluid is deposited in hydraulic reservoir 18.

As mentioned earlier, each piston 272 is maintained biased toward the abutment plate 340 under force of the associated spring 302, the ends of which forceably engage the guide 304 320. Furthermore, as earlier stated, at any point in time four or five of the pistons 272 are forceably urged from left to right (as viewed in the Figures) by influent fluid. This causes the tips 288 of said four or five pistons (at any point in time) to exert a substantial axial though radial eccentric force upon the angularly disposed abutment plate 340.

The large capacity full flow rotating distributor 140 rotates with the main shaft 760 and the wobble plate 370, so that each piston 272 is urged left to right by the mentioned hydraulic fluid beginning at or instantaneously after the wobble plate is relatively disposed at top dead center. Thus, the four and sometimes five pistons which are applying force to the abutment plate 340 do so between top and bottom dead center, with the four and sometimes five pistons 272 exhausting hydraulic fluid between bottom and top dead center. The mentioned orientation may be readily achieved by placing corresponding marks upon the left end of the main shaft 760 and upon valve 140 so that the two marks are aligned as the valve and main shaft are assembled at spline connectors 148 and 762.

As indicated earlier, the wobble plate 370 and associated structure must be placed at some angle of inclination other than 90 degrees in respect to the axis of the motor 10, preferably between 70 degrees and 85 degrees. This is achieved by causing a desired amount of hydraulic fluid to be displaced by pump 20 along line 26 or 28 to one side or the other of piston 600. A corresponding amount of hydraulic fluid is exhausted through the other of lines 26 and 28. Thus, piston 600 is axially displaced a desired distance commensurate with the degree angle of inclination desired. The regulation of hydraulic fluid to piston 600 may be varied from time to time to change the angle of inclination during, subsequent or preceding operation of the motor 10.

The trailing end 602 of the piston 600 is axially joined to the actuator 460 because the inner race of the bearing 510 is press fit upon annulus 602 and the outer race press fit against the annulus 500 of the actuator 460. Thus, the actuator 460 is caused to move axially as the piston 600 moves axially.

Axial displacement of the actuator 460 likewise causes a corresponding displacement of the link 420, which is joined by pin 480 passing through aligned apertures 478 and 424. The angular orientation of the link 420 (as best shown in FIG. 3) accommodates a shifting of the connector 440 along the slot 428 between the fork 426 of the link 420. Because the counterweight 520 is connected by pin 541 to the sliding connector 440, the counterweight is elevated and lowered along the slot 492 in response to axial displacement of the actuator 460. Thus, the operation is at all times substantially free of vibration.

Because the wobble plate 370 is connected by pin 371 to the main shaft 760, wobble plate 370 not only rotates with the main shaft 760 but may not be axially displaced in respect to the main shaft. Accordingly, advancement and retraction of the link 420 in response to displacement of the piston 600 does not axially displace the wobble plate 370 but causes the wobble plate to pivot fore or aft about the pin 371 an angular distance corresponding to the axial displacement of the piston 600. This is true because pin 419 pivotally joins the link 420 and the wobble plate 370 across apertures 418 and 422.

It is to be appreciated that by adjusting the angle of inclination of the wobble plate 370 the user is able to optionally increase the power and decrease the speed, or increase speed and decrease the power of the output shaft 760, the greater the angle of inclination in respect to the axis of the motor 10 the lower the torque and the greater the speed. Furthermore, the motor 10, for example only, can be initially caused to operate such that the wobble plate 370 has a high angle of inclination producing lower speed and higher power or torque at the output end 794 of the main shaft 760 and, thereafter, during operation the angle of inclination of the wobble plate 70 may be changed one or more times by the operator to increase speed and decrease power available at the output portion 790 of the main shaft 760. This makes motor 10 ideal for use with automobiles as schematically depicted in FIG. 1.

Figure 26:
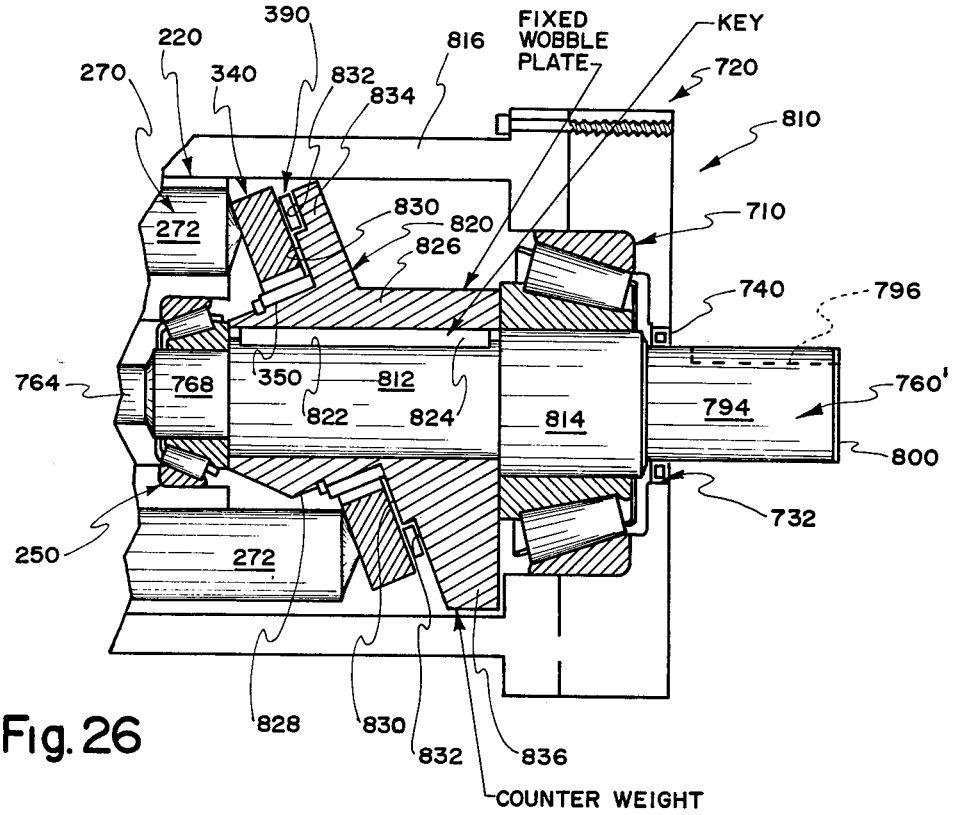
FIG. 26 is a fragmentary longitudinal cross sectional view of a second presently preferred fluid drive mechanism according to the present invention.

Reference is now made to FIG. 26, which illustrates a second motor embodiment, generally designated 810, according to the present invention.

Because the left portion (as viewed in the Figures) of motor 810 may be and preferably is the same as that previously described in connection with motor 10, the description thereof is not repeated. Accordingly, for purposes of this description everything to the left of the abutment plate 340 is the same. This includes the cylinder housing 220, the piston assemblies 270 including the pistons 272 thereof, as well as the bearing 250. Abutment plate 340 is carried at the fixed angle of inclination upon previously described centrally inserted bearing 350 against needle bearing 390.

The main shaft 760' is a slight variation of the previously described shaft 760. Only the variations will be described which comprise (in lieu of portion 772, 778 and 788) enlarged portions 812 and 814. Enlarged portion 814 carries bearing 710, as earlier described, the bearings 710 being interposed between the end pieces 720, the housing 816 and the enlarged portion 814 of the shaft 760'. A fixed angle one-piece wobble plate mechanism 820 is non-rotatably carried upon shaft portion 812 by a key 822 - key way 824 interlock.

Fixed wobble plate 820 comprises a hollow central boss portion 826, interposed between bearings 250 and 710, an angularly disposed annular surface 828 upon which the bearing 350 is press fit at its inner race. Angular annular surface 828 merges at 90 degree angles with abutment surface 830, against which the leading edge of the abutment plate 340 rests. The surface 830 is disposed at the fixed angle of inclination desired for the wobble 820 and is stepped at 832 to receive the previously described needle bearing 390. At top dead center, the fixed wobble plate 820 comprises an angular relatively narrow flange 834, the trailing face of which comprises the previously mentioned surface 830. At bottom dead center the flange 834 has been enlarged to comprise a counterweight 836 to alleviate vibration.

The operation of the motor 810 is identical to the operation of motor 10 as earlier described except that the angle of inclination of the wobble plate 830 and the abutment plate 340 may not be varied and, therefore, the speed and power of the output portion 794 of the shaft 760' will remain constant for a given supply of hydraulic fluid at a constant pressure.

Figure 27:
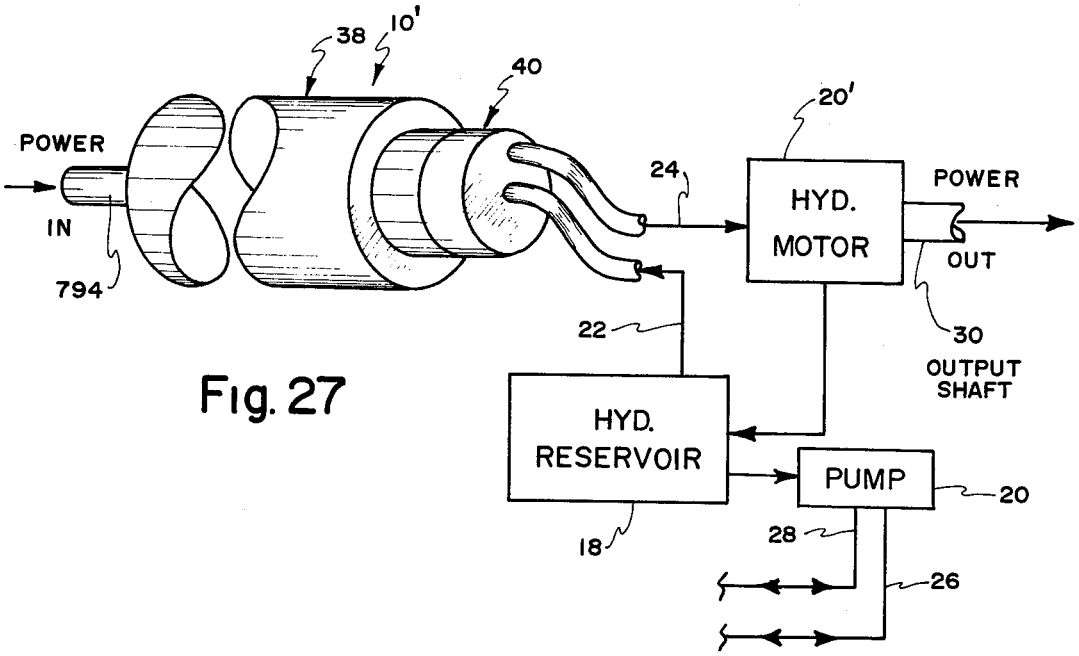
FIG. 27 is a schematic representation of an additional presently preferred fluid drive mechanism according to the present invention used as a fluid pump system as opposed to a fluid motor system.

Reference is now made to FIG. 27, which illustrates utilization of the previously described motor 10 as a pump, which is generally designated 10' in FIG. 27. No changes are made in the structure of the motor 10 to produce the variable pump 10'. However, line 24 is connected to hydraulic motor 20', and line 22 to the hydraulic reservoir. The end 794 of the shaft 760 is coupled to a conventional motor or in any other suitable fashion caused to turn, with the wobble plate previously described adjusted by causing hydraulic fluid from pump 20 to be appropriately displaced through lines 26 and 28 to locate the piston and wobble plate as desired. Rotation of the shaft 760 will cause fluid from reservoir 18 to circulate through the motor in such a fashion that reciprocation of the pistons 272 pressurizes the fluid and discharges it from the pump 10' along line 24 to provide appropriate output power at output shaft 30.

The invention may be embodied in other specific forms without departing from the spirit or essential characteristics thereof. The present embodiments are therefore considered in all respects as illustrative and not restrictive, the scope of the invention being indicated by the appended claims rather than by the foregoing description, and all changes which come within the meaning and range of equivalency of the claims are therefore intended to embraced therein.

What is claimed and desired to be secured by United States Letters Patent is:

1. A fluid drive mechanism comprising:

main shaft means having operable connecting means at one end only;

means journaling the main shaft means for aligned rotation;

angularly disposed power transmitting means at least part of which is non-rotatably connected to the main shaft means;

power means comprising an array of pistons reciprocably disposed within cylinder means;

inlet means by which ingress fluid is delivered to the mechanism;

outlet means by which egress fluid passes from the mechanism;

fluid flow control and distribution means at least part of which is relatively displaceable in respect to the inlet and outlet means, the fluid flow control and distribution means comprising means receiving the ingress fluid from the inlet means and first internal passageway means selectively delivering ingress fluid sequentially to the pistons of the power means, the angularly disposed power transmitting means and the main shaft means rotating in sequence with displacement of the pistons, the first internal passageway means being sized, shaped and located so as to pass ingress fluid selectively to the pistons substantially without reduction in pressure and without restriction in flow;

the fluid flow control and distribution means further comprising second internal passageway means selectively successively accommodating communication of egress fluid from the pistons and means delivering the egress fluid to the outlet means, the second internal passageway means being sized, shaped and located so as to pass the egress fluid selectively to the outlet means substantially without reduction in pressure and without restriction in flow.

2. A mechanism according to claim 1 wherein the mechanism comprises a fluid pump and the operable connecting means at the one end only of the main shaft means provide power input.

3. A mechanism according to claim 1 wherein the mechanism comprises a fluid motor and the operable connecting means at the one end only of the main shaft means comprises power take-off means.

4. A mechanism according to claim 1 wherein at least part of the fluid flow control and distribution means is non-rotatably connected to the shaft means and comprise first port means selectively passing ingress fluid to the pistons successively and second port means selectively passing egress fluid from the pistons.

5. A fluid drive mechanism comprising:

main shaft means exposed at at least one end;

means journaling the main shaft means for aligned rotation;

angularly disposed power transmitting means at least part of which is non-rotatably connected to the main shaft means;

power means comprising an array of pistons reciprocably disposed within cylinder means;

inlet means by which ingress fluid is delivered to the mechanism;

outlet means by which egress fluid passes from the mechanism;

fluid flow control and distribution means comprising means receiving the ingress fluid from the inlet means and first internal passageway means selectively delivering ingress fluid sequentially to the pistons of the power means, the angularly disposed power transmitting means and the main shaft means rotating in sequence with displacement of the pistons, the first internal passageway means being sized, shaped and located so as to pass ingress fluid selectively to the pistons substantially without reduction in pressure and without restriction in flow;

the fluid flow control and distribution means further comprising second internal passageway means selectively successively accommodating communication of egress fluid from the pistons and means delivering the egress fluid to the outlet means, the second internal passageway means being sized, shaped and located so as to pass the egress fluid selectively to the outlet means substantially without reduction in pressure and without restriction in flow;

at least part of the fluid flow control and distribution means being non-rotatably connected to the shaft means and comprise dynamic annular reservoirs on opposed sides of the fluid flow control and distribution means exerting equal and opposite uniform pressure thereupon to accommodate unencumbered rotation of the fluid flow control and distribution means in response to rotation of the shaft means.

6. A mechanism according to claim 1 wherein the fluid flow control and distribution means comprise stationary flow control means and rotating flow distribution means.

7. A mechanism according to claim 1 further comprising housing means substantially surrounding and structurally stabilizing the remainder of the mechanism.

8. A mechanism according to claim 1 wherein the cylinder means comprise an array of equally spaced cylinder bores each eccentrically disposed along a common radius within a cylindrically shaped block, each cylinder bore containing one of said pistons in substantially fluid tight relation.

9. A mechanism according to claim 8 wherein each piston comprises a spring biased head contiguously engaging the power transmitting means, fluid being selectively communicated to and from the side of each piston not contiguous with the power transmitting means through one end of the associated cylinder bore.

10. A fluid drive mechanism comprising:

main shaft means exposed at at least one end;

means journaling the main shaft means for aligned rotation;

angularly disposed power transmitting means at least part of which is non-rotatably connected to the main shaft means, the angularly disposed power transmitting means comprise rotating inclined wobble plate means and counterbalance means connected to the wobble plate means;

power means comprising an array of pistons reciprocably disposed within cylinder means;

inlet means by which ingress fluid is delivered to the mechanism;

outlet means by which egress fluid passes from the mechanism;

fluid flow control and distribution means comprising means receiving the ingress fluid from the inlet means and first internal passageway means selectively delivering ingress fluid sequentially to the pistons of the power means, the angularly disposed power transmitting means and the main shaft means rotating in sequence with displacement of the pistons, the first internal passageway means being sized, shaped and located so as to pass ingress fluid selectively to the pistons substantially without reduction in pressure and without restriction in flow;

the fluid flow control and distribution means further comprising second internal passageway means selectively successively accommodating communication of egress fluid from the pistons and means delivering the egress fluid to the outlet means, the second internal passageway means being sized, shaped and located so as to pass the egress fluid selectively to the outlet means substantially without reduction in pressure and without restriction in flow.

11. A mechanism according to claim 10 further comprising an abutment plate rotatably associated with the rotating wobble plate means and interposed between the rotating wobble plate means and the pistons.

12. A mechanism according to claim 10 wherein the counterbalance means comprise an integral eccentric extension of the rotating wobble plate means.

13. A mechanism according to claim 10 wherein the counterbalance means comprise means separate from the rotating wobble plate means and connected thereto by pivotable link means.

14. A mechanism according to claim 10 further comprising means for varying the angle of inclination of the power transmitting means.

15. A mechanism according to claim 14 wherein the varying means comprise reciprocable means axially reciprocable by selectively applying pressurized fluid, the reciprocable means being eccentrically pivotally connected by linkage to the rotatable wobble plate means and to the counterbalance means such that fluid displacement of the reciprocable means in either direction will correspondingly change (a) the angle of inclination of the rotatable wobble plate means and (b) the eccentricity of the counterbalance means.

16. A mechanism according to claim 15 wherein the angle of inclination of the rotatable wobble plate means varies about the center of pin means non-rotatably joining the rotatable wobble plate means to the main shaft means.

17. A fluid mechanism comprising:

a plurality of associated non-rotating power means selectively in communication with ingress and egress fluid;

rotating distribution means defining continually moving opposed distribution ingress and distribution egress fluid passageway means sequentially accommodating displacement of ingress and egress fluid to and from the non-rotating power means on a timed basis without substantial change in fluid pressure and without substantial restriction of fluid flow;

stationary means comprising separate ingress and egress passageway means respectively at all times communicating fluid to and from the distribution ingress and egress fluid passageway means without substantial change in pressure and without substantial restriction in flow.

18. A fluid mechanism comprising:

a plurality of associated power means selectively in communication with ingress and egress fluid;

rotating distribution means defining continually moving opposed distribution ingress and distribution egress fluid passageway means sequentially accommodating displacement of ingress and egress fluid to and from the power means on a timed basis without substantial change in fluid pressure and without substantial restriction of fluid flow;

stationary means comprising separate ingress and egress passageway means respectively at all times communicating fluid to and from the distribution ingress and egress fluid passageway means without substantial change in pressure and without substantial restriction in flow;

anti-binding means to aid in smooth displacement of the rotating distribution means comprising means causing fluid to be diverted from the ingress-egress flow path thereof into fluid pressure bearing sites on opposite sides of the distribution means.

19. A mechanism according to claim 18 wherein each site comprises an arcuate groove formed in part in the distribution means and in part in the stationary structure adjacent the distribution means.

20. A fluid drive mechanism comprising:

shaft means;

means journaling the shaft means for rotation;

power transmitting means;

means non-rotatably joining the shaft means and the power transmitting means;

the power transmitting means comprising transversely projecting wobble plate means, counterweight means, means for selectively varying the angle of inclination of the wobble plate means and means correspondingly adjusting the eccentricity of the counterbalance means.

21. A method of distributing fluid to and from fluid power means comprising the steps of:

continuously displacing ingress fluid substantially without reduction in pressure and substantially without restriction in flow to a distribution site adjacent non-rotating power means;

continuously helically distributing the displaced fluid sequentially and cyclically to successive reciprocable parts of the non-rotating power means substantially without reduction in pressure and substantially without restriction in flow;

continuously exhausting fluid from the power means.

22. A method of controlling the operation of a fluid distributor comprising the steps of:

continuously displacing ingress fluid to a rotating fluid distributor at a distribution site, the rotating distributor being interposed between stationary members;

continuously passing the displaced fluid across the distribution site while enhancing the rotation of the distributor by continuously directing a portion of the fluid into eccentrically aligned chambers on opposite sides of the distributor, each chamber comprising a large groove and being formed in both the distributor and one of the stationary members.

23. A method of varying the speed and power of a fluid mechanism comprising the steps of:

providing a fluid mechanism having shaft means with connection means at one end only;

interrelating fluid power means and power transmitting means;

non-rotatably joining the power transmitting means to the shaft means and rotatably joining the power means to the shaft means;

coordinating the displacement of fluid, the operation of the power means and the rotational speed and power of the power transmitting means and shaft means;

using fluid pressure to both (a) vary the orientation of the power transmitting means in respect to both the power means and the shaft means to correspondingly vary the speed and power of the power transmitting means and shaft means and (b) provide power to or from the mechanism.

24. A fluid drive mechanism comprising:

shaft means;

means journaling the shaft means for rotation;

power means comprising cylinder block means rotatably carried by the shaft means and a plurality of radially disposed piston means reciprocably carried by the cylinder block means;

fluid distribution means at least part of which is non-rotatably joined to the shaft means, the fluid distribution means defining during operation continually moving opposed distribution ingress fluid passageway means and distribution egress fluid passageway means, sequentially accommodating displacement of ingress and egress fluid to and from the respective piston means on a timed basis without substantial change in fluid pressure and without substantial restriction of fluid flow, the fluid distribution means further comprising fluid seal means which at any point in time (a) separate the ingress fluid from the egress fluid, (b) accommodate delivery of ingress fluid to only some of the piston means while prohibiting fluid exhaust therefrom and (c) accommodate exhausting of egress fluid from only others of the piston means while prohibiting entry of ingress fluid thereto.

25. A fluid drive mechanism according to claim 24 wherein the fluid distribution means further comprise second fluid seal means preventing escape of ingress fluid from the mechanism and third fluid seal means preventing escape of egress fluid from the mechanism.

26. A fluid drive mechanism according to claim 25 wherein each of the three fluid seal means comprise a metal ring which rotates as part of the fluid distribution means in close sealing proximity to adjacent stationary structure.

27. A fluid drive mechanism according to claim 24 wherein the fluid distribution means have a generally disc-shape, the ingress fluid passageway means comprise a series of large adjacent ingress openings substantially located along a common radius over an arcuate distance substantially less than 360 degrees, the large ingress openings being separated by generally radially-directed spokes, and the egress fluid passageway means comprising a series of large adjacent egress openings substantially located along a second different common radius over a second different arcuate distance substantially less than 360 degrees, the large egress openings being separated by generally radially-directed other spokes.

28. A fluid drive mechanism according to claim 27 further comprising other ingress and egress fluid passageway means disposed substantially along the two mentioned radii at arcuate locations other than the arcuate locations of the large ingress and egress openings so that ingress and egress fluid is always instantaneously available to each piston means as shaft means rotation occurs and to equalize fluid pressure on opposite sides of the disc-shaped fluid distribution means to insure facile rotation.

* * * * *